US011188006B2

(12) United States Patent
Jougataki

(10) Patent No.: US 11,188,006 B2
(45) Date of Patent: Nov. 30, 2021

(54) DEVELOPMENT UNIT AND IMAGE FORMATION APPARATUS

(71) Applicant: Oki Data Corporation, Tokyo (JP)

(72) Inventor: Kouhei Jougataki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/099,351

(22) Filed: Nov. 16, 2020

(65) Prior Publication Data

US 2021/0157255 A1 May 27, 2021

(30) Foreign Application Priority Data

Nov. 25, 2019 (JP) ..... JP2019-212230

(51) Int. Cl.
*G03G 15/08* (2006.01)

(52) U.S. Cl.
CPC ..... *G03G 15/0808* (2013.01)

(58) Field of Classification Search
None
See application file for complete search history.

(56) References Cited

U.S. PATENT DOCUMENTS

2004/0230011 A1* 11/2004 Hattori ..... C08L 71/03 525/343
2005/0202946 A1* 9/2005 Hattori ..... C08G 18/168 492/56
2009/0012196 A1* 1/2009 Kim ..... C08J 9/42 521/163
2011/0064486 A1* 3/2011 Furuya ..... G03G 15/0818 399/281
2014/0029987 A1* 1/2014 Masui ..... G03G 15/0865 399/281
2015/0338771 A1* 11/2015 Masui ..... G03G 15/0808 399/281
2015/0359134 A1* 12/2015 Soong ..... H05K 7/2039 361/720
2018/0194916 A1* 7/2018 Yamaoka ..... C08L 83/04
2018/0373178 A1* 12/2018 Sato ..... G03G 15/0808
2020/0301307 A1* 9/2020 Narita ..... G03G 15/0258

FOREIGN PATENT DOCUMENTS

JP 2019-8140 A 1/2019

* cited by examiner

*Primary Examiner* — Sevan A Aydin
(74) *Attorney, Agent, or Firm* — Metrolex IP Law Group, PLLC

(57) ABSTRACT

A developer supply member according to an embodiment may be configured such that in a case where a developer supply member is rotated at a circumferential speed of 136.1 mm/sec while an abrasive film including a grain size of 30 μm fixed on a stainless steel indenter including a surface in a shape of a 50 mm squire and a thickness of 10 mm is pressed into an elastic layer of the developer supply member by 0.73 mm, an amount of decrease in an outer diameter of the developer supply member, obtained by subtracting a value of the outer diameter of the developer supply member when the indenter is separated from the developer supply member 250 seconds after the pressed-into amount of the indenter reaches 0.73 mm from a value of the outer diameter of the developer supply member before the indenter is pressed into, is 0.03 mm or less.

10 Claims, 17 Drawing Sheets

FIG. 13

| ITEM | | EXAMPLES | | | | | | | COMPARATIVE EXAMPLES | | | | | | | | |
|---|---|---|---|---|---|---|---|---|---|---|---|---|---|---|---|---|---|
| | | 1 | 2 | 3 | 4 | 5 | 6 | 7 | 1 | 2 | 3 | 4 | 5 | 6 | 7 | 8 | 9 |
| THICKNESS OF FOAM ELASTIC LAYER [mm] | | 3.5 | 3.5 | 3.5 | 3.5 | 3.5 | 3.5 | 3.5 | 3.5 | 3.5 | 3.5 | 3.5 | 3.5 | 3.5 | 3.5 | 3.5 | 3.5 |
| PUSHING AMOUNT [mm] | | 0.73 | 0.73 | 0.73 | 0.73 | 0.73 | 0.73 | 0.73 | 0.73 | 0.73 | 0.73 | 0.73 | 0.73 | 0.73 | 0.73 | 0.73 | 0.73 |
| CELL DIAMETER [μm] | | 405 | 380 | 394 | 434 | 472 | 480 | 396 | 284 | 263 | 278 | 573 | 479 | 504 | 313 | 330 | 369 |
| CELL WALL THICKNESS [μm] | | 30.2 | 29.4 | 31.4 | 27.9 | 32.2 | 33.0 | 25.3 | 26.2 | 24.7 | 25.9 | 23.3 | 18.5 | 22.8 | 24.6 | 22.9 | 24.3 |
| CELL AREA RATIO [%] | | 58 | 56 | 60 | 57 | 56 | 54 | 59 | 64 | 60 | 61 | 48 | 45 | 47 | 64 | 62 | 61 |
| ELONGATEDNESS [%/N/mm$^2$] | | 81.6 | 81.6 | 72.6 | 72.6 | 72.6 | 75.6 | 72.6 | 65.8 | 61.8 | 69.4 | 87.0 | 91.2 | 85.8 | 65.8 | 61.8 | 69.4 |
| REPULSIVE FORCE ATTENUATION RATE [%] | | 28 | 31 | 27 | 31 | 31 | 29 | 28 | 24 | 26 | 27 | 33 | 34 | 36 | 30 | 31 | 33 |
| WEAR TEST RESULT | OUTER DIAMETER REDUCTION [mm] | 0.03 | 0.03 | 0.02 | 0.02 | 0.03 | 0.03 | 0.02 | 0.05 | 0.05 | 0.06 | 0.05 | 0.06 | 0.05 | 0.07 | 0.06 | 0.06 |
| | WEIGHT LOSS [g] | 0.07 | 0.06 | 0.07 | 0.04 | 0.05 | 0.05 | 0.06 | 0.31 | 0.30 | 0.20 | 0.01 | 0.02 | 0.04 | 0.21 | 0.22 | 0.19 |
| IMAGE EVALUATION | | ○ | ○ | ○ | ○ | ○ | ○ | ○ | × | × | × | × | × | × | × | × | × |

DEVELOPMENT UNIT AND IMAGE FORMATION APPARATUS

CROSS REFERENCE TO RELATED APPLICATIONS

This application claims priority based on 35 USC 119 from prior Japanese Patent Application No. 2019-212230 filed on Nov. 25, 2019, entitled "DEVELOPMENT UNIT AND IMAGE FORMATION APPARATUS", the entire contents of which are incorporated herein by reference.

BACKGROUND

This disclosure may relate to a development unit used for image formation by electrophotography and an image formation apparatus equipped with a development unit.

An electrophotographic image formation apparatus is equipped with a development unit including a development roller (developer carrier) configured to develop a latent image formed on a surface of an image carrier and a supply roller (developer supply member) configured to supply a developer to the development roller (see, e.g., Patent Document 1).

Patent Document 1: Japanese Patent Application Publication No. 2019-8140 (see, e.g., FIGS. 1 and 4)

SUMMARY

The supply roller not only supplies the developer to the development roller, but also scrapes off (removes) the developer that remains on the surface of the development roller. However, over time, the capacity of scraping off the developer may be declined, which may cause smudges (stains) in the image.

An object of an embodiment of the disclosure may be to suppress a decrease in the capacity of scraping off the developer by the developer supply member, thereby improving the image quality.

A first aspect of the disclosure may be a development unit that may include a developer carrier configured to supply a developer to an image carrier to thereby develop a latent image on the image carrier, and a developer supply member disposed in contact with the developer carrier, including an elastic layer on a surface of the developer supply member and configured to supply the developer to the developer carrier. When a wear test is conducted in which the developer supply member is rotated at a circumferential speed of 136.1 mm/sec in a state where a stainless steel indenter having a surface in shape of a 50 mm squire and having a thickness of 10 mm is pressed into the elastic layer of the developer supply member by 0.73 mm in such a manner that an abrasive film including a grain size of 30 μm fixed on the surface of the indenter is in press contact with the surface of the elastic layer, a decrease in an outer diameter of the developer supply member, which is obtained by subtracting a value of the outer diameter of the developer supply member when the indenter is separated 250 seconds after a pressed-in amount of the indenter reaches 0.73 mm from a value of the outer diameter of the developer supply member before the indenter is pressed in, is 0.03 mm or less.

The development unit according to another aspect may include a developer carrier configured to supply a developer to an image carrier to thereby develop a latent image on the image carrier, and a developer supply member disposed in contact with the developer carrier, including an elastic layer on a surface of the developer supply member and configured to supply the developer to the developer carrier. When a tensile test in accordance with JIS-K6251 is conducted on a test piece in a shape of a dumbbell No. 1 and formed from the material after vulcanization and before foaming of the elastic layer, a value obtained by dividing an elongation rate (%) of the test piece when the test piece is broken by a stress ($N/mm^2$) in the test piece when the test piece is broken is 72.6 or more and 81.6 or less.

A third aspect of the disclosure may be an image formation apparatus that may include the development unit according to one of the above aspects, a transfer unit configured to transfer a developer image formed on the image carrier to a medium, and a fixation unit configured to fix the developer image transferred to the medium to the medium.

According to at least one of the aspects, a decrease in the developer scraping capacity (the developer removing capacity) of the developer supply member can be suppressed and thus the image quality can be improved.

BRIEF DESCRIPTION OF DRAWINGS

FIG. 13 is a table illustrating evaluation results of Examples 1 to 7 and Comparative Examples 1 to 9.

DETAILED DESCRIPTION

Figure 1:
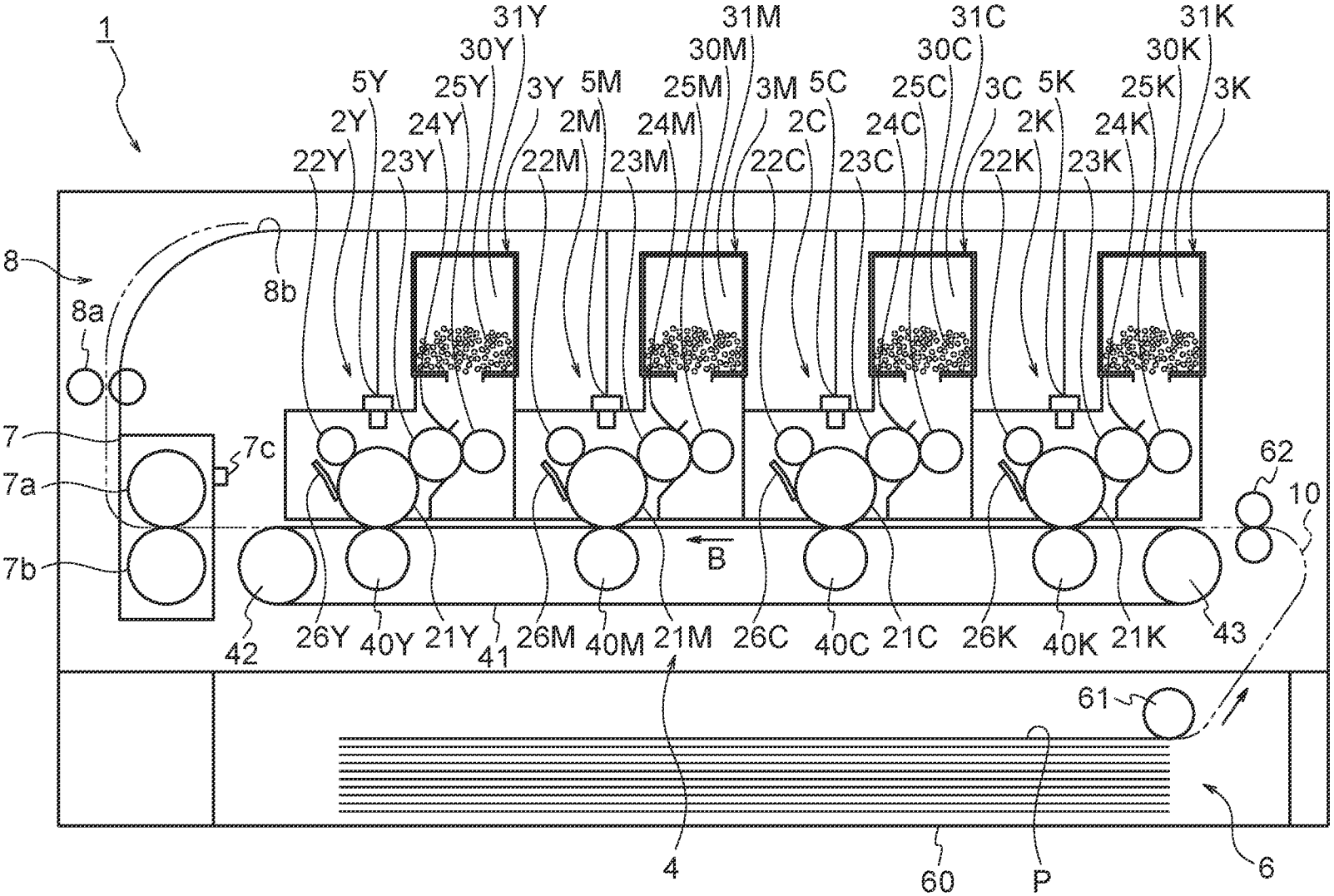
FIG. 1 is a diagram illustrating a view of an image formation apparatus according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<Configuration of Image Formation Apparatus>

FIG. 1 is a diagram illustrating a view of a basic configuration of an image formation apparatus 1 according to an embodiment. In this example, the image formation apparatus 1 is configured as a color electrophotographic printer. The image formation apparatus 1 includes a media supply unit 6 configured to supply a medium P such as printing paper, process units 2K, 2C, 2M, and 2Y serving as development units configured to form toner images (developer images) of respective colors, and LED heads 5K, 5 C, 5M, and 5Y configured to emit lights to photosensitive drums 21 of the process units 2K, 2C, 2M, and 2Y respectively, a transfer unit 4 configured to transfer the toner images to the medium P, a fixation unit 7 or a fixation device configured to fix the transferred toner images to the medium P, and a media discharge unit 8 configured to discharge the medium P.

The media supply unit 6 includes a paper cassette 60 as a media accommodation section to store therein the media P, a feed roller 61 configured to feed the media P stored in the paper cassette 60 into a conveyance path 10, and conveyance rollers 62 configured to convey the media P fed into the conveyance path 10 to the process units 2K, 2C, 2M and 2Y.

The paper cassette 60 stores therein the media P, such as printing paper, sheets, or the like, in a stacked state and is detachably mounted at a lower portion of the image formation apparatus 1.

The feed roller 61 feeds the media P from the paper cassette 60 one by one to the conveyance path 10. The conveyance rollers 62 are a pair of rollers, which is configured to convey the medium P fed by the feed roller 61 into the conveyance path 10 to the process units 2K, 2C, 2M, and 2Y, while correcting a skew of the medium P.

The process units 2K, 2C, 2M, and 2Y are configured to form black, cyan, magenta, and yellow toner images, respectively. The process units 2K, 2C, 2M, and 2Y are arranged in line (from right to left in FIG. 1) along the conveyance path 10. The process units 2K, 2C, 2M, and 2Y are detachably mounted to a body of the image formation apparatus 1.

Figure 2:
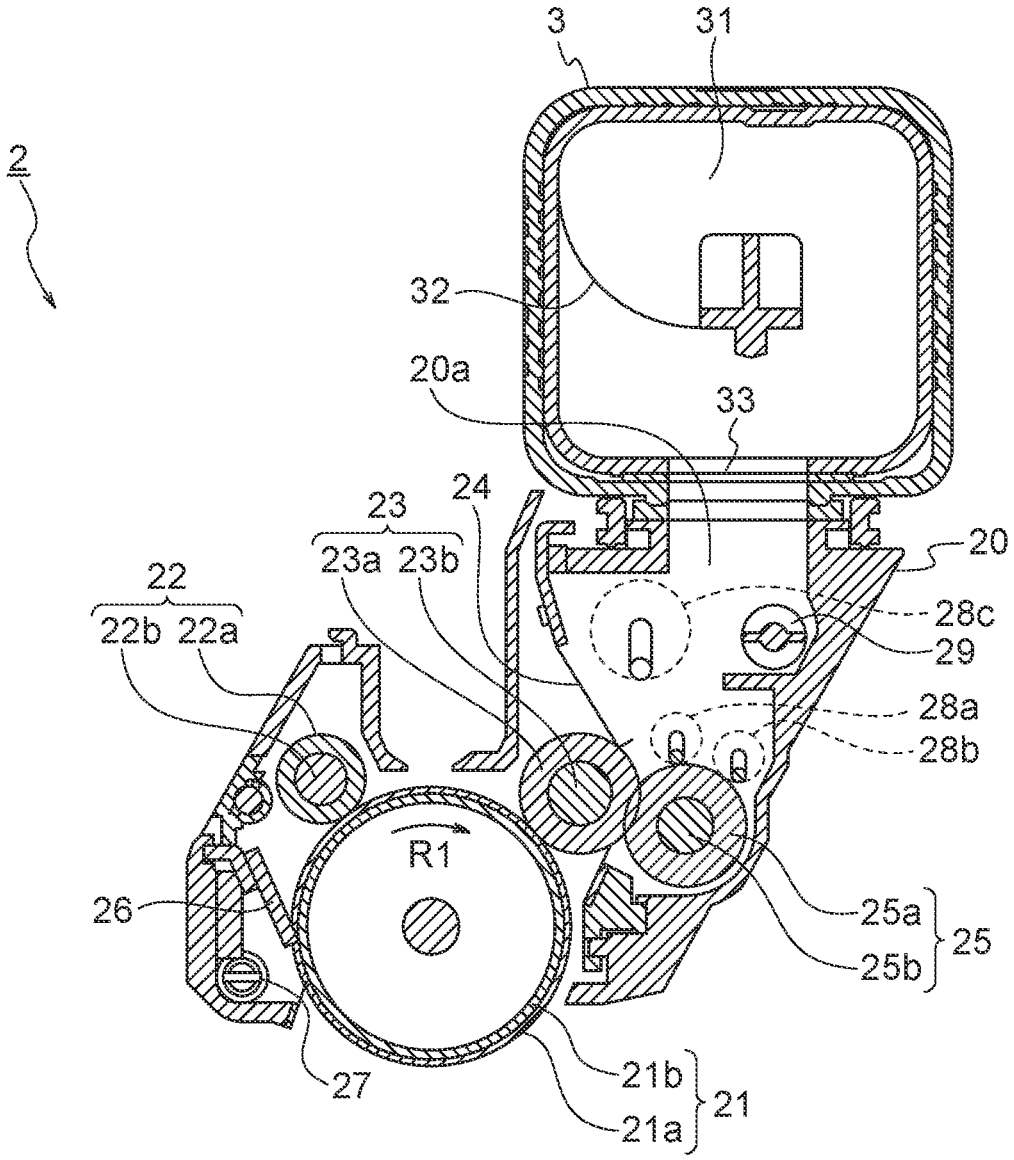
FIG. 2 is a diagram illustrating a cross-sectional view of a process unit according to an embodiment.

FIG. 2 is a diagram illustrating a cross-sectional view of the process unit 2. The process units 2K, 2C, 2M, and 2Y have the same configuration with each other, except for the toner (developer) to be used. Therefore, the process units 2K, 2C, 2M, 2Y and their components may be referred without the reference signs K, C, M, and Y.

As illustrated in FIG. 2, the process unit 2 includes a photosensitive drum 21 as an image carrier. The photosensitive drum 21 is configured to rotate in a direction indicated by the arrow R1 in FIG. 1. Around the photosensitive drum 21, the charging roller 22 as a charging member, the development roller 23 as a developer carrier, and the cleaning blade 26 as a cleaning member are arranged along a rotational direction of the photosensitive drum 21.

Around the development roller 23, a supply roller 25 as a developer supply member and a development blade 24 as a layer regulation member are also disposed. Above the supply roller 25 and the development blade 24, a toner chamber 20*a* is formed, which is a space for accommodating therein the toner. An axial direction of each roller of the process unit 2 and a longitudinal direction of the development blade 24 are parallel to an axial direction of the photosensitive drum 21.

The toner chamber 20*a* is provided with agitation members 28*a*, 28*b*, and 28*c* configured to agitate the toner in the toner chamber 20*a* and a conveyance screw 29 configured to uniformly smooth the toner in the axial direction in the toner chamber 20*a*. The detailed explanations of these are omitted.

A toner cartridge 3 (developer container) is attached to the process unit 2, for refilling the toner to the process unit 2. The toner cartridge 3 is detachably mounted, for example, on an upper portion of a body 20 of the process unit 2.

The toner cartridge 3 includes a toner container room 31 which accommodates therein the toner and an agitation bar 32 which is provided in the toner container room 31 and configured to agitate the toner. The bottom portion of the toner cartridge 3 is provided with a toner supply port 33 that supplies the toner to the toner chamber 20*a* of the process unit 2.

The photosensitive drum 21 has a cylindrical conductive support 21*b* and a photoconductive layer 21*a* formed on the surface of the conductive support 21*b*. The conductive support 21*b* is composed of, for example, a metal pipe, such as aluminum or the like. The photoconductive layer 21*a* is composed of a layered structure including a charge generation layer and a charge transport layer. A blocking layer (intermediate layer) may be provided between the conductive support 21*b* and the photoconductive layer 21*a*.

The charging roller 22 is provided in contact with the surface of the photosensitive drum 21 and is configured to rotate along with the rotation of the photosensitive drum 21. The charging roller 22 includes, for example, a shaft 22*b* made of metal and an elastic layer 22*a* formed on the surface of the shaft 22*b*. The elastic layer 22*a* is a semi-conductive rubber layer comprising a semi-conductive epichlorohydrin rubber, for example.

The development roller 23 is arranged such that the development roller 23 is in contact with the surface of the photosensitive drum 21. The development roller 23 rotates at a predetermined circumferential speed ratio in a direction opposite to the rotational direction of the photosensitive drum 21 (i.e., so that a direction of rotational movement of the surface of the development roller 23 and a direction of rotation movement of the surface of the photosensitive drum 21 at the contact area therebetween are the same). The development roller 23 includes a shaft 23*b* made of a metal such as stainless steel or like, for example, and an elastic layer 23*a* formed on the surface of the shaft 23*b*. The elastic layer 23*a* is composed of, for example, a semi-conductive urethane rubber. A surface treatment layer may be provided on the surface of the elastic layer 23*a*.

The development blade 24 is a metal plate member having a length approximately same as an axial length of the elastic layer 23*a* of the development roller 23. The thickness of the development blade 24 is, for example, 0.08 mm. The development blade 24 is fixed at one end thereof to the body 20 of the process unit 2, and a bend portion formed at the other end portion of development blade 24 is pressed against the surface of the development roller 23. The development blade 24 regulates the thickness of the toner layer formed on the surface of the development roller 23.

The supply roller 25 is arranged such that the supply roller 25 is in contact with the surface of the development roller 23. The supply roller 25 rotates at a predetermined circumferential speed ratio in a rotational direction same as the rotational direction of the development roller 23 (i.e., a direction of movement of the surface of the supply roller 25 and a direction of movement of the surface of the development roller 23 at the contact area therebetween are opposite to each other). The supply roller 25 includes, for example, a core 25*b* made of metal and a conductive foam layer 25*a* (sponge layer) provided on the surface of the core metal 25*b*.

The cleaning blade 26 is composed of, for example, a urethane rubber and is arranged to contact the surface of the photosensitive drum 21. The cleaning blade 26 is configured to scrape off residual toner remaining on the surface of the photosensitive drum 21, so as to remove the residual toner.

Note that the process unit 2 may be referred to as a development unit. Also a portion of the process unit 2 that develops the latent image on the photosensitive drum 21 (i.e., a portion of the process unit 2 that includes the development roller 23 and the supply roller 25) may be referred to as a development unit.

Returning to FIG. 1, the LED heads 5K, 5C, 5M, and 5Y as the exposure devices are arranged opposite to the upper sides of the photosensitive drums 21K, 21C, 21M, and 21Y of the process units 2K, 2C, 2M, and 2Y. Each of the LED heads 5K, 5C, 5M, and 5Y includes LEDs (light-emitting diodes) and a lens array. The lights emitted from the LEDs are projected and focused onto the surface of each of the photosensitive drums 21K, 21C, 21M, and 21Y.

The transfer unit 4 is located below the process units 2K, 2C, 2M, and 2Y. The transfer unit 4 includes a transfer belt 41, which electrostatically adsorbs and transports the medium P, a drive roller 42 and a tension roller 43 over which the transfer belt 41 is stretched, and four transfer rollers 40K, 40C, 40M, and 40Y as transfer members arranged opposite to the photosensitive drums 21K, 21C, 21M, and 21Y of the process unit 2K, 2C, 2M, and 2Y.

The drive rollers 42 are driven to be rotated by the conveyance motor 113 (see FIG. 3), to cause the transfer belt 41 to run in a direction indicated by the arrow B. The tension roller 43 applies a predetermined amount of tension to the transfer belt 41.

The transfer belt 41 adsorbs the medium P on its surface and runs by rotation of the drive rollers 42 to convey the medium P along the process units 2K, 2C, 2M and 2Y. The transfer belt 41 is composed of polyamideimide or polyamide or the like, and contains additive such as carbon or the like added therein to obtain electrical conductivity and mechanical strength.

The transfer rollers 40K, 40C, 40M, 40Y are pressurized to the photosensitive drums 21K, 21C, 21M, and 21Y, respectively, via the transfer belt 41. A transfer voltage is applied to the transfer rollers 40K, 40C, 40M, and 40Y so as to transfer the toner images formed on the surfaces of the photosensitive drums 21K, 21C, 21M, and 21Y to the medium P.

The fixation unit 7 is located downstream (left side in FIG. 1) of the process units 2K, 2C, 2M, and 2Y in the conveyance direction of the medium P. The fixation unit 7 is provided with a fixation roller 7*a*, a pressure roller 7*b*, and a thermistor 7*c*.

The fixation roller 7*a* includes, for example, a heat-resistant elastic layer made of silicone rubber around a hollow cylindrical core made of aluminum, and a tetrafluoroethylene-perfluoroalkyl vinyl ether copolymer (PFA) tube covering the surface of the heat-resistant elastic layer. A heater, such as a halogen lamp or the like, is provided inside the core of the fixation roller 7*a*.

The pressure roller 7*b* includes, for example, a heat-resistant elastic layer made of silicone rubber on the surface of an aluminum core, and a PFA tube covering the surface of the heat-resistant elastic layer. A pressure contact portion (nip portion) is formed between the pressure roller 7*b* and the fixation roller 7*a*.

Figure 3:
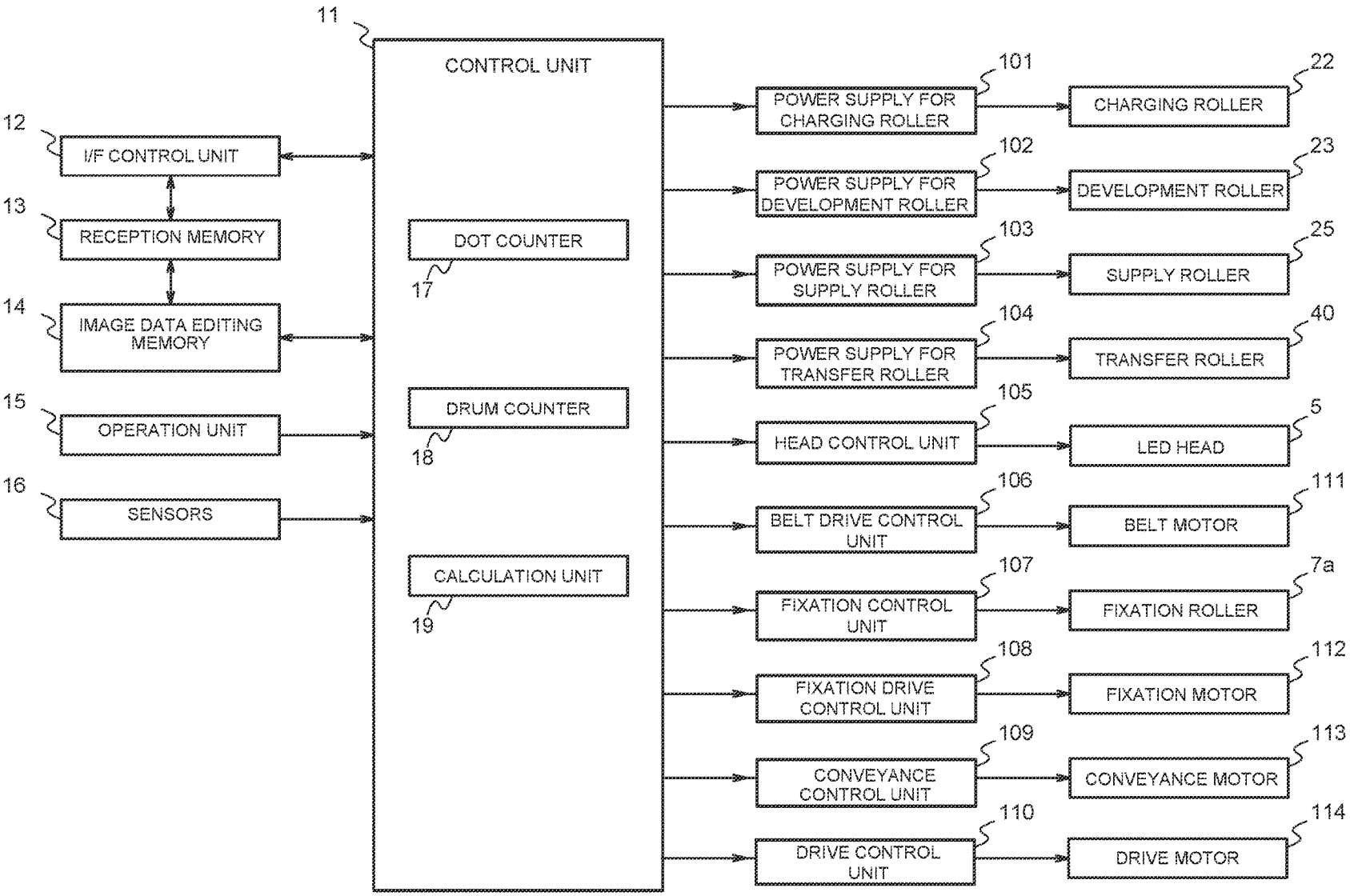
FIG. 3 is a block diagram illustrating a view of a control related configuration of the image formation apparatus according to an embodiment.

The thermistor 7*c* functions as a temperature detector to detect the temperature of the surface of the fixation roller 7*a* and is disposed in the vicinity of the fixation roller 7*a* without being in contact with the fixation roller 7*a* (in a non-contact manner). The temperature information detected by the thermistor 7*c* is output to a fixation control unit 107 (FIG. 3). The fixation control unit 107 controls the heater in the fixation roller 7*a* to turn on and off based on the temperature information of the thermistor 7*c* so as to maintain the surface temperature of the fixation roller 7*a* at a predetermined temperature.

The media discharge unit 8 includes discharge rollers 8*a*, which are composed of a pair of rollers that discharge the medium P conveyed from the fixation unit 7 to the outside of the image formation apparatus 1. An upper cover of the image formation apparatus 1 is provided with a stacker 8*b* on which the media P discharged by the discharge roller 8*a* are to be stacked.

The process units 2K, 2C, 2M, and 2Y and the toner cartridges 3Y, 3M, 3C, and 3K are replaceable units in the image formation apparatus 1. Therefore, when any component of them is deteriorated or when the toner is used up in any of them, they can be replaced.

<Control System of Image Formation Apparatus>

Next, a control system of the image formation apparatus 1 is described. FIG. 3 is a block diagram illustrating a view of the control system of the image formation apparatus 1. As illustrated in FIG. 3, the image formation apparatus 1 includes a control unit 11, an interface control unit 12, a reception memory 13, an image data editing memory 14, an operation unit 15, and a group of sensors 16.

The control unit 11 includes, for example, a microprocessor, ROM, RAM, input/output ports, and a timer. The control unit 11 receives print data and control commands from an external device or a host device such as a personal computer or the like, and controls an overall sequence of the image formation apparatus 1 to perform printing operations.

The control unit 11 includes a dot counter 17, a drum counter 18, and a calculation unit 19. The dot counter 17 counts the number of dots required for printing based on the image data in the image data editing memory 14. The drum counter 18 counts the number of revolutions of the photosensitive drum 21 rotated during the printing operation. The calculation unit 19 performs the calculation based on the temperature information and other information input from the group of sensors 16 and the number of revolutions counted by the drum counter 18.

The interface control unit 12 transmits the information of the image formation apparatus 1 (printer information) to the external device, analyzes the commands received from the external device, and also processes the data received from the external device.

The reception memory 13 temporarily records the print data inputted from the external device via the interface control unit 12. The image data editing memory 14 receives the print data recorded in the reception memory 13, edits and processes the print data to generate image data and records the generated image data.

The operation unit 15 includes a display unit (e.g., an LED) displaying the status of the image formation apparatus 1 and an input unit (e.g., a switch) to which the operator inputs instructions for the image formation apparatus 1. The group of sensors 16 includes various sensors for monitoring the operating state of the image formation apparatus 1, such as a paper position sensor for detecting the position of the medium P, a temperature and humidity sensor for detecting the temperature and humidity around the image formation apparatus 1, a density sensor for detecting the density of the image, and the like.

The image formation apparatus 1 also includes a power supply 101 for the charging roller, a power supply 102 for the development roller, a power supply 103 for the supply roller, a power supply 104 for the transfer roller, a head control unit 105, a belt drive control unit 106, a fixation control unit 107, a fixation drive control unit 108, a conveyance control unit 109, and a drive control unit 110.

The power supply 101 for the charging roller applies a charging voltage to the charging roller 22 to uniformly charge the surface of the photosensitive drum 21. The power supply 102 for the development roller applies a development voltage to the development roller 23 to adhere the toner to the electrostatic latent image on the photosensitive drum 21. The power supply 103 for the supply roller applies a supply voltage to the supply roller 25 to supply the toner to the development roller 23. The power supply 104 for the transfer roller applies a transfer voltage to the transfer roller 40 to transfer the toner (toner image) on the photosensitive drum 21 to the medium P.

Note that the power supply 101 for the charging roller, the power supply 102 for the development roller, the power supply 103 for the supply roller, and the power supply 104 for the transfer roller are provided for each of the process units 2K, 2C, 2M, and 2Y. In FIG. 3, only ones of these are illustrated.

The head control unit 105 sends the image data recorded in the image data editing memory 14 to the LED head 5 to control the emission of the LED head 5. The head control unit 105 is provided to each of the LED heads 5K, 5C, 5M, and 5Y. In FIG. 3, only one of the head control units 105 is illustrated.

The belt drive control unit 106 drives the belt motor 111, which rotates the drive roller 42 of the transfer unit 4, to run the transfer belt 41.

The fixation control unit 107 applies a voltage to the heater of the fixation roller 7*a* of the fixation unit 7 based on the temperature detected by the thermistor 7*c*, and maintains the temperature of the fixation roller 7*a* at the predetermined temperature (fixation temperature).

The fixation drive control unit 108 drives the fixation motor 112, which rotates the fixation roller 7*a* of the fixation unit 7. The rotation of the fixation motor 112 is also transmitted to the discharge roller 8*a* of the media discharge unit 8.

The conveyance control unit 109 drives the conveyance motor 113, which rotates the feed roller 61 and the conveyance rollers 62.

The drive control unit 110 controls the rotation of the drive motor (drum motor) 114 which rotates the photosensitive drum 21. Note that the rotation of the photosensitive drum 21 is transmitted to the development roller 23 and the supply roller 25 via a transmission gear(s) or the like. The charging roller 22 is also rotated along with the rotation of the photosensitive drum 21.

<Basic Operation of Image Formation Apparatus>

Next, the basic operation of the image formation apparatus 1 is described with reference to FIGS. 1 and 3. In the state where the process units 2K, 2C, 2M, and 2Y of the image formation apparatus 1 are refilled with black, cyan, magenta, and yellow toners from toner cartridges 3K, 3C, 3M, and 3Y respectively, they are ready to print.

When the control unit 11 of the image formation apparatus 1 receives print data and control commands from the external device such as a personal computer via the interface control unit 12, the printing operation (image forming operation) is started.

In accordance with the instruction from the control unit 11, the conveyance control unit 109 drives the conveyance motor 113 to rotate the feed roller 61 of the media supply unit 6, so as to feed the medium P from the paper cassette 60 to the conveyance path 10. The medium P fed to the conveyance path 10 is further conveyed by the conveyance rollers 62 toward the process units 2K, 2C, 2M, and 2Y.

The belt drive control unit 106 drives the belt motor 111 to rotate the drive roller 42 of the transfer unit 4, causing the transfer belt 41 to run in a direction indicated by the arrow B. The transfer belt 41 adsorbs and holds the medium P and conveys the medium P through the process units 2K, 2C, 2M, and 2Y.

Based on the instruction from the control unit 11, the drive control unit 110 drives the drive motor 114 to rotate the photosensitive drums 21K, 21C, 21M, and 21Y. The rotation of the drive motor 114 is also transmitted to the development rollers 23K, 23C, 23M, and 23Y and the supply rollers 25K, 25C, 25M, and 25Y, so as to rotate the development rollers 23K, 23C, 23M, and 23Y and the supply rollers 25K, 25C, 25M, and 25Y.

In the process units 2K, 2C, 2M, and 2Y, the charging rollers 22K, 22C, 22M, and 22Y are charged by the power supply 101 for the charging rollers to uniformly charge the surface of the photosensitive drums 21K, 21C, 21M, and 21Y, respectively.

The head control unit 105 drives the LED heads 5K, 5C, 5M, and 5Y to expose the surfaces of the photosensitive drums 21K, 21C, 21M, and 21Y based on the image data of respective colors, so as to form electrostatic latent images on the surfaces of the photosensitive drums 21K, 21C, 21M, and 21Y, respectively.

The development rollers 23K, 23C, 23M, and 23Y are imparted with the development voltage by the power supply 102 for the development rollers, so as to charge the toners attached to the surfaces the development rollers 23K, 23C, 23M, and 23Y.

The development blades 24K, 24C, 24M, and 24Y, which are pressed against the development rollers 23K, 23C, 23M, and 23Y, regulate the thickness of the toner layers on the surfaces of the development rollers 23K, 23C, 23M, and 23Y, respectively. Note that a bias voltage (blade voltage) may be applied to the development blades 24K, 24C, 24M, and 24Y.

The supply rollers 25K, 25C, 25M, and 25Y are imparted with the supply voltage by the power supply 103 for the supply rollers and supply the toners supplied from the toner cartridges 3K, 3M, 3Y, and 3C to the development rollers 23K, 23C, 23M, and 23Y.

The supply rollers 25K, 25C, 25M, and 25Y also charge the toners by contact friction with the development rollers 23K, 23C, 23M, and 23Y and scraping (i.e., collecting) from the development rollers 23K, 23C, 23M, and 23Y the toners that have not used for development.

The cleaning blades 26K, 26C, 26M, and 26Y scrape off the toners remaining on the surfaces of the photosensitive drums 21K, 21C, 21M, and 21Y, so as to remove the remaining toners. The removed toners (waste toners) are conveyed by the transport spiral (not illustrated), so as to be collected.

The transfer rollers 40K, 40C, 40M, and 40Y of the transfer unit 4 are imparted with the transfer voltage by the power supply 104 for the transfer rollers, and transfer the toner images of respective colors from the photosensitive drums 21K, 21C, 21M, and 21Y to the medium P.

The medium P having the toner images of the respective colors transferred thereon is further conveyed to the fixation unit 7 by the transfer belt 41.

In the fixation unit 7, the fixation control unit 107 controls the heater of the fixation roller 7*a* to maintain the surface temperature of the fixation roller 7*a* at the predetermined temperature. The fixation drive control unit 108 drives the fixation motor 112 to rotate the fixation roller 7*a*. As the medium P passes through the pressure contact area (fixation nip) between the fixation roller 7*a* and the pressure roller 7*b*, heat and pressure are applied to the toner images on the medium PP, so that the toner images are fixed to the medium P.

The medium P, on which the toner images are fixed, is discharged by the discharge roller 8*a* of the media discharge unit 8 to the outside of the image formation apparatus 1 and thus is placed on the stacker 8*b*.

<Configuration and Manufacturing Method of Supply Roller 25>

Figure 4A:
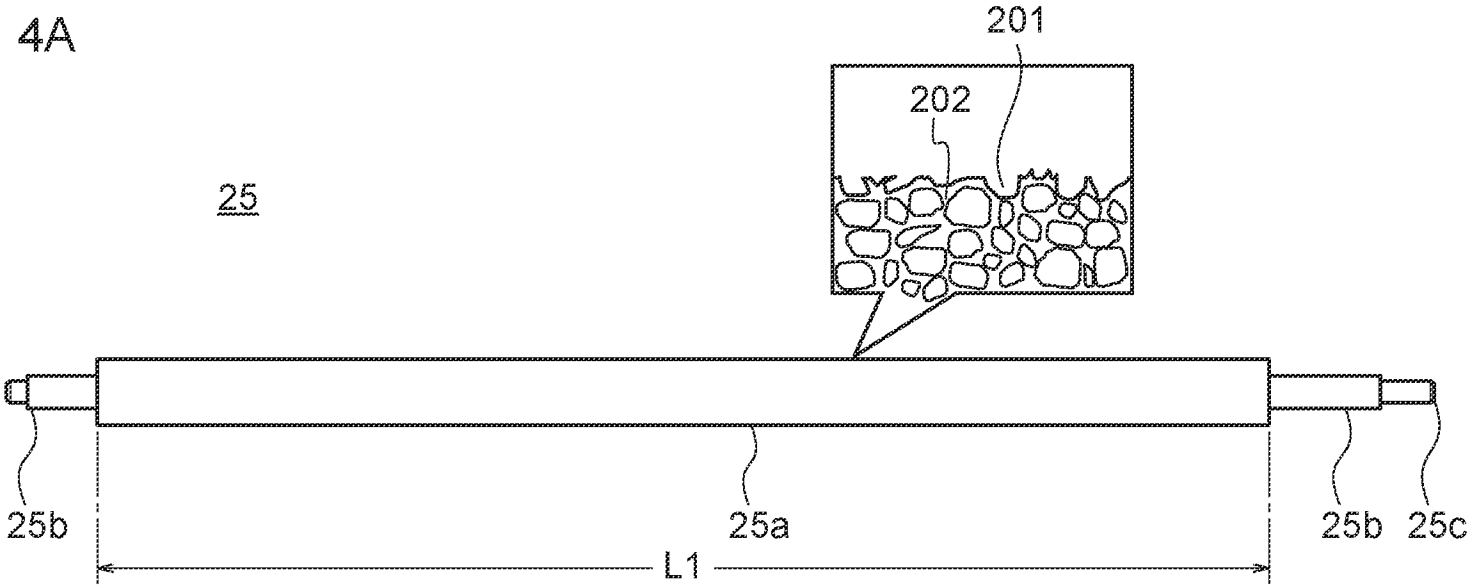
FIGS. 4A and 4B are diagrams illustrating a side view and a cross-sectional view of a supply roller according to an embodiment.
Figure 4B:
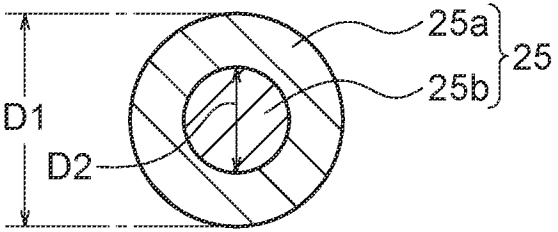

Next, a configuration and a manufacturing method of the supply roller 25 according to an embodiment are described. FIG. 4A is a diagram illustrating a front view of the supply roller 25, and FIG. 4B is a diagram illustrating a cross-sectional view of the supply roller 25. As described above, the supply roller 25 includes the core (shaft) 25*b* and the conductive foam layer 25*a* serving as an elastic layer formed on the surface of the core 25*b*.

The outer diameter D1 of the conductive foam layer 25*a* is, for example, 13 mm, and the outer diameter D2 of the core 25*b* is, for example, 6 mm. The axial length L1 of the conductive foam layer 25*a* is, for example, 222 mm. An adhesive layer may be formed between the conductive foam layer 25*a* and the core 25*b*.

The core 25*b* is formed of a rigid and conductive metal, such as iron, copper, brass, stainless steel, aluminum, nickel, or etc. However, the core 25*b* may be composed of a material other than a metal as long as the material has rigidity and conductivity. For example, the core 25*b* may be formed of a resin molded product, ceramics, or the like with dispersed conductive particles therein.

The core 25*b* may be in a shape of a roll or a hollow pipe. The end portion of the core 25*b* may be formed with a step 25*c*, a pin hole or the like, for attaching the gears. The core 25*b* may be formed at the end portion thereof with a bearing portion having a smaller diameter than that of the central portion (i.e., the portion surrounded by the conductive foam layer 25*a*).

The outer diameter of the conductive foam layer 25*a* is constant in the axial direction. However, the conductive foam layer 25*a* may be in a crown or a tapered shape in which the outer diameter thereof decreases as it approaches the axial end of the supply roller 25. The conductive foam layer 25*a* may have different diameters at both axial end portions of the supply roller 25.

The conductive foam layer 25*a* includes a number of cells (air cells) 201 that are exposed to the surface of the conductive foam layer 25*a*. The cells 201 are independent (closed) air cells which are not continuous with each other. Between adjacent cells 201, a wall section (referred to as a cell wall) 202 is formed.

The rubber material of the conductive foam layer 25*a* may be, for example, silicone rubber, urethane rubber, ethylene-propylene-diene rubber (EPDM), acrylic rubber, ethylene-propylene rubber, styrene-butadiene rubber, acrylonitrile butadiene rubber, butadiene rubber, isoprene rubber, chloroprene rubber, butyl rubber, or etc.

It is preferable that the rubber material of the conductive foam layer 25*a* contains silicone rubber as a main component thereof. This is because the silicone rubber has independent air cells such as being described above. The main component is defined as a component that accounts for 50% by weight of the total. The silicone rubber may also be a modified silicone rubber.

Figure 5:
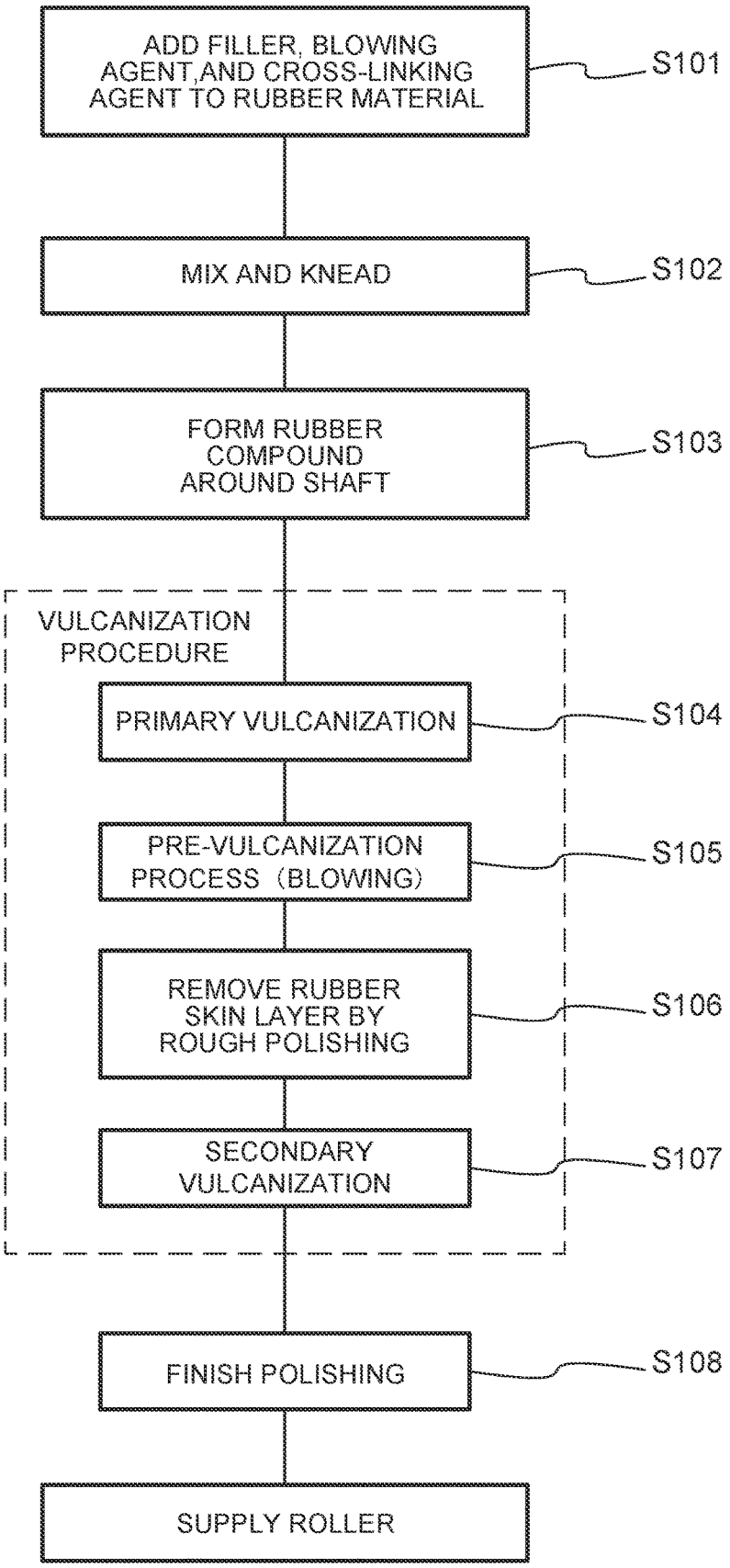
FIG. 5 is a flowchart for explaining a manufacturing process of a supply roller according to an embodiment.

Next, the manufacturing process of the supply roller 25 is described. FIG. 5 is a flowchart illustrating the manufacturing process of the supply roller 25. First, a filler, a foaming agent (blowing agent), and a cross-linking agent are added to the rubber material described above (step S101).

The filler may be composed of a reinforcing filler and/or a conductive filler. As the reinforcing filler, for example, silica (fumed silica or settling silica), reinforcing carbon black, and the like can be used. As the conductive filler, for example, metal powders such as conductive carbon black, nickel, aluminum, copper, or the like, metal oxides such as zinc oxide, or barium sulfate, titanium oxide, potassium titanate and the like coated with tin oxide can be used. In this embodiment, titanium, reinforcing carbon black, and conductive carbon black are used as the filler.

An azo compound-based foaming agent (in this case, azobisisobutyl nitrile: AIBN) is used as the foaming agent. However, bicarbonate-based, isocyanate-based, nitrite, hydrazina derivatives, or azide compound foaming agent may be used instead of the azo compound foaming agent.

Peroxide and sulfur-based vulcanizing agent are used as the cross-linking agent (vulcanizing agent). However, instead of these, an isocyanate agent or hydrogen siloxane in the presence of a platinum catalyst may be used.

The rubber material to which the filler, the foaming agent and the cross-linking agent are added as described above is mixed and kneaded using a pressurized kneader, a mixing roll, or the like (step S102).

The kneaded rubber composition is filled into an extrusion machine and is extruded around the core 25*b* (step S103). As a result, a cylindrical rubber composition covering around the surface of the core 25*b* is formed. In the following, a body in which the rubber composition (rubber compound) is formed on the surface of the core 25*b* is referred to as a roller body.

Next, the formed roller body is set in a heating furnace and heated to a temperature required for vulcanization of the rubber (step S104). In this process (primary vulcanization process), vulcanization of the rubber proceeds, but no foam is produced.

After the primary vulcanization process, a pre-vulcanization process (step S105) for foaming is performed. In the pre-vulcanization process, the roller body is heated at a temperature higher than that in the primary vulcanization process described above. This causes formation of bubbles (air cells) due to foaming, and the vulcanization of the rubber also proceeds. Step S105 and step S107 described below are referred to as a foaming process.

After the pre-vulcanization process, the roller body is taken out from the heating furnace and an outer perimeter of a foam layer of the roller body is roughly ground (step S106). Here, a range of several millimeters thicknesses of the outer perimeter (surface) of the foam layer is removed by the rough grinding. In the primary vulcanization process and the pre-vulcanization process described above, a skin layer with small air cells is formed around the outer perimeter of the foam layer, and this skin layer is removed by the rough grinding.

After that, the roughly-ground roller body is set in the heating furnace and a secondary vulcanization process (step S107) is performed. In the secondary vulcanization process, the roller body is heated to a temperature higher than the heating temperature in the primary vulcanization process. Consequently, air cells are further formed, and vulcanization of the rubber further proceeds.

Since the skin layer is removed before the secondary vulcanization process, unbalance (distortion) of the cross-linking state of the rubber can be reduced, and air cells can be uniformly formed (that is, air cells with a uniform size can be formed over the entire surface of the foam layer). Also, in the secondary vulcanization process, low-molecular siloxane derived from silicone is removed by volatilization, and since the skin layer has been removed from the surface of the foam layer as described above, the low-molecular siloxane can be effectively removed.

After the secondary vulcanization process, finish machining is performed on the surface of the foam layer of the roller body, so as to obtain the roller body (the supply roller 25) having a predetermined outer diameter (step S108). Consequently, the supply roller 25 is obtained, in which the conductive foam layer 25*a* is formed on the surface of the core 25*b*.

<Characteristics of Supply Roller 25>

Next, the characteristics of the supply roller 25 are further described. The conductive foam layer 25*a* (FIG. 4A) of the supply roller 25 contains the silicone rubber as the main component thereof, as described above. Whereas a common conductive foam layer, which contains urethane rubber as a main component thereof, has continuous air cells, the conductive foam layer 25*a*, which contains the silicone rubber as the main component, has independent air cells.

In a case where a conductive foam layer having continuous air cells therein is used, toner can penetrate deep into the air cells, which may cause the toner to clog up inside the air cells. Therefore, as the number of sheets printed by the image formation apparatus 1 increases, the amount of toner clogged in the air cells increases, resulting in an increase in hardness and electrical resistance of the conductive foam layer, which may result in uneven images (blur) caused by insufficient toner supply.

In contrast, in a case where the conductive foam layer 25*a* having closed air cells is used, toner does not penetrate deep into the air cells and thus clogging of the toner in the air cells is unlikely to occur. Therefore, even if the number of sheets printed by the image formation apparatus 1 increases, the hardness and the electrical resistance of the conductive foam layer 25*a* do not increase so much, and an occurrence of unevenness (blur) in the image is also suppressed.

The hardness of the conductive foam layer 25*a* is adjusted by an amount of the foaming agent (e.g., azobisisobutyl nitrile) added. It is preferable that the Asker F hardness of the conductive foam layer 25*a* is not less than 40 degrees and not greater than 46 degrees.

If the Asker F hardness of the conductive foam layer 25*a* is greater than 46 degrees, the load on the toner increases, resulting in higher graininess (roughness) of the image, and the durability is reduced due to increased wear at the contact between the two rollers 23 and 25. On the other hand, if the Asker F hardness of the conductive foam layer 25*a* is less than 40 degrees, the amount of the foaming agent required for hardness adjustment may be too high, resulting in an uneven foaming state, and the quality of the supply roller 25 may not be stable.

The size of the cells (air cells) 201 of the conductive foam layer 25*a* and the thickness of the cell wall 202 dividing the cells 201 can also be varied depending on the amount of the foaming agent added. In this embodiment, the size (cell diameter) of the cells 201 is 380 to 480 μm (micrometer) and the thickness of the cell walls 202 is 25.3 to 32.2 μm, as described below.

The supply roller 25 not only supplies the toner to the development roller 23, but also scrapes off the residual toner that is not transferred to the photosensitive drum 21 and thus remaining on the surface of the development roller 23. As the supply roller 25 wears, the contact pressure between the development roller 23 and the supply roller 25 is reduced and the scraping capacity is reduced. This may cause smudging (stains) in the image. The term "smudging" refers to adhesion of the toner to an area of the medium P where an image should not be formed (a white area).

In the following, characteristics of the supply roller 25 to improve the scraping capacity are described. The characteristics of the supply roller 25 are evaluated based on: (A) an elongatedness in a tensile test of JIS-K6251; (B) a repulsive force attenuation rate in a load rotation test in which a cylindrical indenter is pressed against the supply roller 25, and (C) an amount of decrease in the outer diameter and an amount of decrease in the weight of the supply roller 25 in a wear test (abrasion test) performed with an indenter with an abrasive film fixed thereon being pressed against the supply roller 25. These are explained in detail below.

<Tensile Test>

Figure 6:
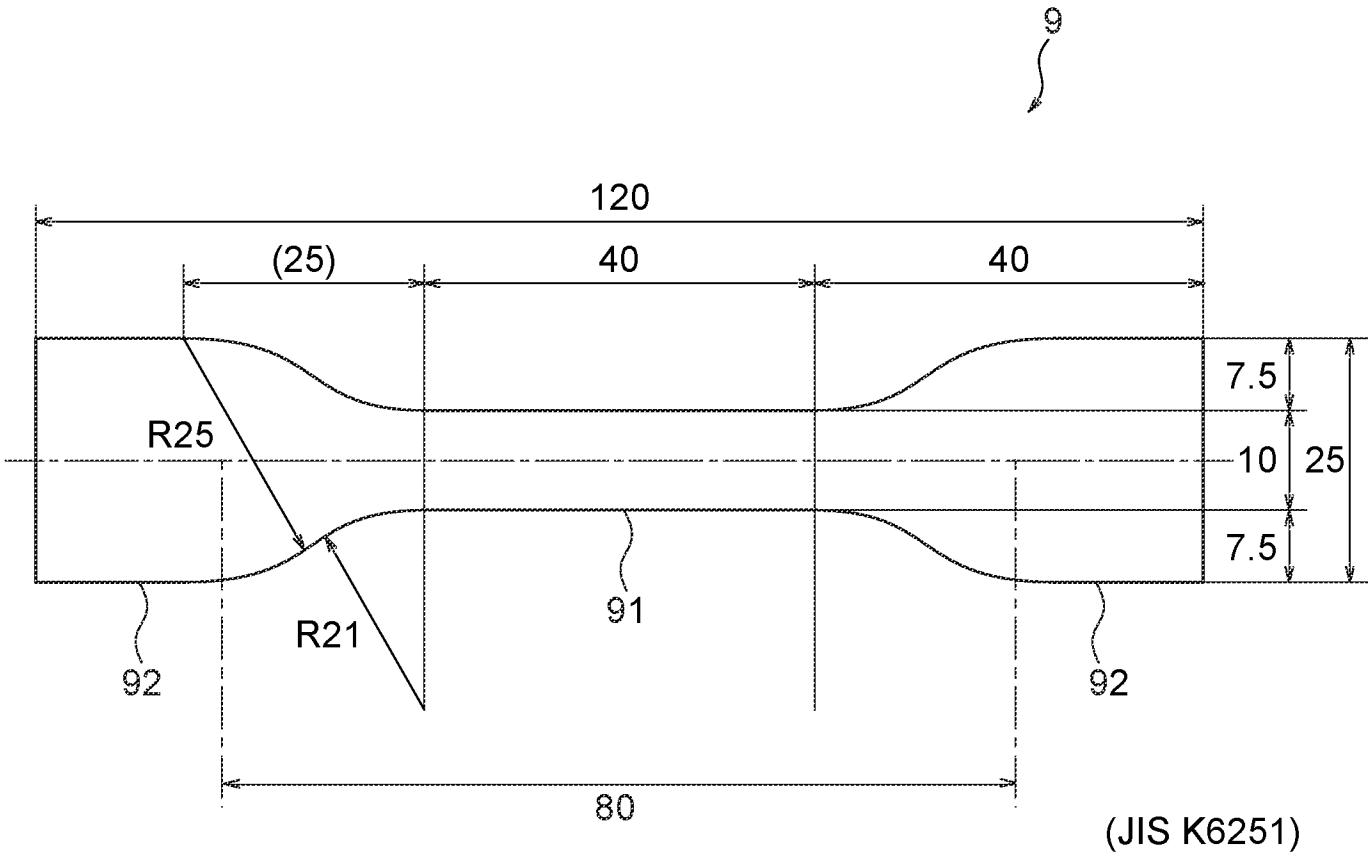
FIG. 6 is a diagram illustrating a view of a test piece made of a rubber material of a conductive foam layer according to an embodiment.

The rubber material after the vulcanization and before the foaming process (solid rubber material) for forming the conductive foam layer 25*a* of the supply roller 25 is used to form a test piece 9 in a shape of a dumbbell No. 1 as specified in JIS-K6251, as illustrated in FIG. 6. The test piece 9 is a long plate-like piece extending in one direction, including a parallel section 91 in a center portion of a longitudinal direction of the test piece 9 and grip sections 92 at both longitudinal end portions of the test piece 9. Note that the rubber material after the vulcanization and before the foaming process is the rubber material after the vulcanization process of step S104 and before the pre-vulcanization process of step S105 in the manufacturing process of the supply roller 25 described with reference to FIG. 5.

In FIG. 6, numbers other than the reference numerals 9, 91, and 92 represent dimensions, and the units thereof are mm (millimeter). A total length of the test piece 9 is 120 mm and a distance between mark lines is 80 mm. A width of the parallel section 91 of the test piece 9 is 10 mm and a maximum width of each of the grip sections 92 is 25 mm.

The test piece 9 is mounted on a tensile testing machine and the tensile test in accordance with JIS-K6251 is performed. The grip sections 92 at both end portions of the test piece 9 are grasped by a pair of upper and lower chucks (grasping portions) of a tensile testing machine, and a tensile force is applied in the longitudinal direction of the test piece 9. A distance between the pair of chucks on the test piece 9 is set at 80 mm. A tensile speed by the tensile testing machine is set at 500 mm/min.

A rate of elongation of the test piece 9 when the test piece 9 is broken under the tensile force applied to the test piece 9 is referred to as an elongation rate E (%). More specifically, the elongation rate E (%) is a ratio of a length of the test piece 9 when the test piece 9 is broken to a length (120 mm) of the test piece 9 before the tension is applied.

The stress in the test piece 9 when the test piece 9 is broken, measured in a load cell of the tensile testing machine, is referred to as a stress S ($N/mm^2$).

Here, the value obtained by dividing the elongation rate E (%) of the test piece 9 at break by the stress S ($N/mm^2$) at break is referred to as an elongatedness (%/(N/mm2)). The higher the elongatedness, the more easily the conductive foam layer 25*a* is deformed in the rotational direction. The lower the elongatedness, the more easily the conductive foam layer 25*a* is broken when the conductive foam layer 25*a* is deformed in the rotational direction.

<Load Rotation Test>

Figure 7:
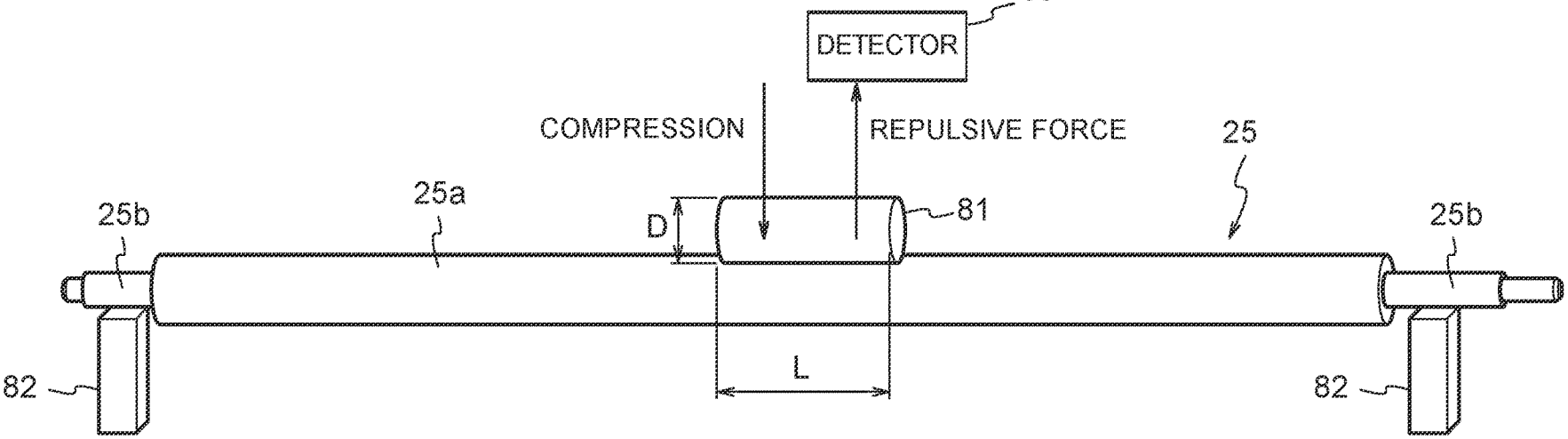
FIG. 7 is a diagram illustrating a schematic view for explaining a load rotation test on the supply roller.

FIG. 7 is a diagram for explaining a load rotation test on the supply roller 25. A testing machine "5543A" available from Intron Co., Ltd. is used as a testing machine for the load rotation test. The testing machine is provided with a pair of supports 82 that rotatably support the core 25*b* of the supply roller 25, as illustrated in FIG. 7.

A cylindrical indenter 81 is pressed against the surface of the conductive foam layer 25*a* at an axial center of the supply roller 25, in a direction orthogonal to the axial direction of the supply roller 25. The indenter 81 is made of stainless steel, and the axial direction of the indenter 81 is parallel to the axial direction of the supply roller 25. An axial length L of the indenter 81 is 50 mm and an outer diameter D of the indenter 81 is 16 mm.

The indenter 81 is pushed into the conductive foam layer 25*a* of the supply roller 25 at a push-in speed of 10 mm/min while the supply roller 25 is rotated at a rotational speed of 200 rpm (circumferential speed 136.1 mm/sec). After the amount of the indenter 81 pushed into the conductive foam layer 25*a* reaches 0.73 mm, the supply roller 25 is rotated for 6 hours while maintaining that state.

The testing machine is equipped with a detector (load cell) 83 that measures a reaction force (i.e., a repulsive force of the conductive foam layer 25*a*) that the indenter 81 receives from the supply roller 25.

The repulsive force measured by the detector 83 at the point in time when the amount of indenter 81 pushed into the conductive foam layer 25*a* reaches 0.73 mm is referred to as an initial repulsive force F1 (N). The repulsive force measured by the detector 83 at the point in time when the supply roller 25 is rotated for 6 hours with the indenter 81 being pushed in by 0.73 mm is referred to as a repulsive force F2 (N) after continuous rotation.

Here, a ratio of the repulsive force F2 (N) after continuous rotation to the initial repulsive force F1 (N) is defined as a rate A (%) of attenuation of the repulsive force (a repulsive force attenuation rate). The attenuation rate (reduction rate) of the repulsive force, A (%), is expressed by the following formula. $A=\{1-(F2/F1)\}\times 100$ <Wear Test>

Figure 8A:
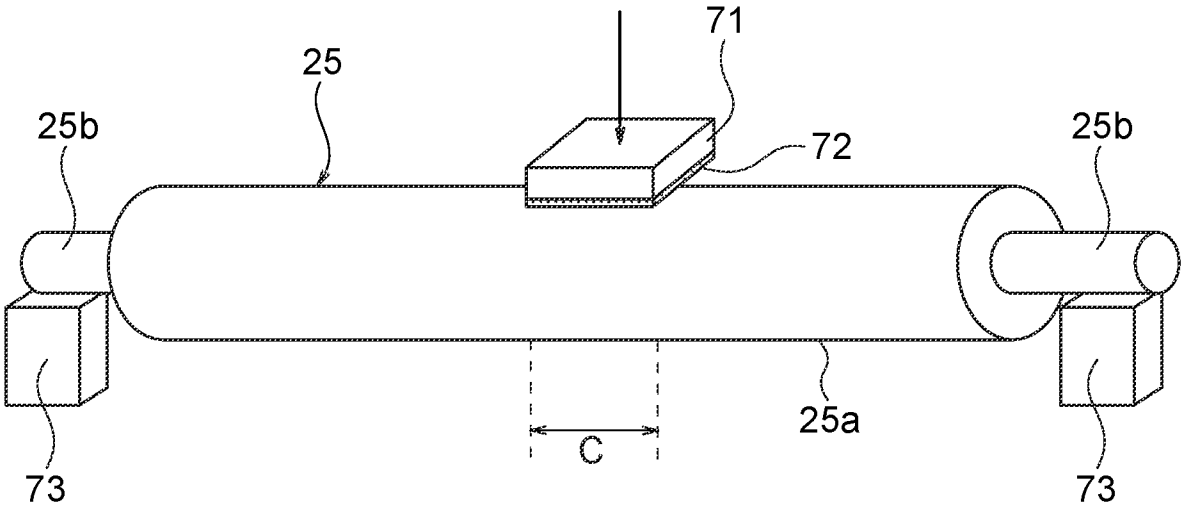
FIG. 8A is a diagram illustrating a schematic view for explaining a wear test on the supply roller.

FIG. 8A is a diagram for explaining a wear test (abrasion test) of the supply roller 25. A testing machine "5543A" available from Intron Co., Ltd. is used as a testing machine for the wear test. The testing machine is provided with a pair of supports 73 that rotatably support the core 25*b* of the supply roller 25, as illustrated in FIG. 8A.

An indenter 71, which is a metal plate, is pressed against the surface of the conductive foam layer 25*a* at the axial center of the supply roller 25, in the direction orthogonal to the axial direction of the supply roller 25.

Figure 8B:
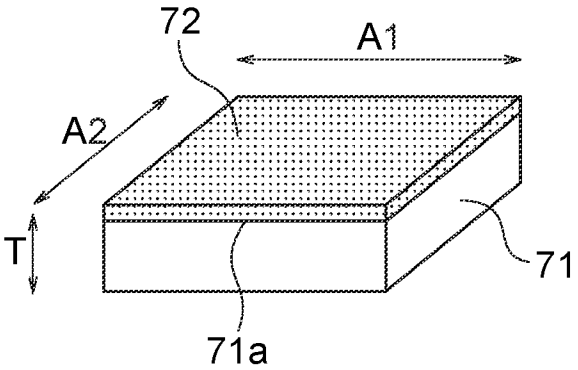
FIG. 8B is a diagram illustrating an enlarged perspective view of an indenter used in the wear test.

FIG. 8B is a diagram illustrating an enlarged perspective view of the indenter 71. The indenter 71 is a plate member made of stainless steel. The indenter 71 includes a square surface 71*a* parallel to the axial direction of the supply roller 25. A length A1 of the surface 71*a* of the indenter 71 in the axial direction of the supply roller 25 and a length A2 of the surface 71*a* of the indenter 71 in a direction orthogonal to the axial direction are both 50 mm. A thickness T of the indenter 71 is 10 mm.

A lapping film (polishing film) 72 with a grain size of 30 μm (#600) is adhered to the surface 71*a* of the indenter 71. As the lapping film 72, "Lapping Film Sheet 30 microns" (LF3-30, A0-SHT) available from Sumitomo 3M Corporation is used. The indenter 71 is pressed against the conductive foam layer 25*a* with the lapping film 72 being in contact with the surface of the conductive foam layer 25*a* of the supply roller 25.

The indenter 71 is pushed into the conductive foam layer 25*a* of the supply roller 25 at a push-in speed of 10 mm/min while the supply roller 25 is rotated at a rotational speed of 200 rpm (a circumferential speed of 136.1 mm/sec). After the amount of the indenter 71 pushed into the conductive foam layer 25*a* reaches 0.73 mm, the supply roller 25 is rotated for 250 seconds while maintaining that state.

Figure 9:
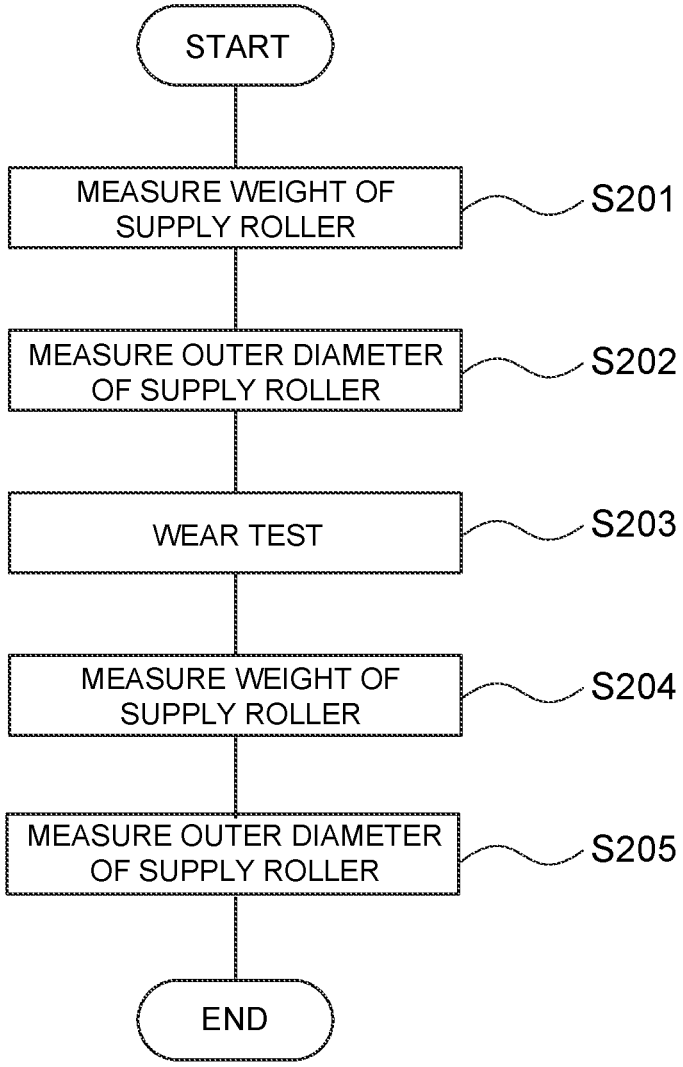
FIG. 9 is a flowchart of a procedure for measuring an amount of decrease in the outer diameter and an amount of decrease in the weight of the supply roller.

FIG. 9 is a flowchart illustrating a procedure for measuring a rate of change in the outer diameter and a rate of change in the weight of the supply roller 25. First, the weight of the supply roller 25 (hereinafter, referred to as weight w1) is measured before starting the wear test (step S201). An electronic balance "UW2200H" available from Shimadzu Corporation is used to measure the weight of the supply roller 25.

Next, the outer diameter of the supply roller 25 (hereinafter, referred to as outer diameter d1) is measured (step S202). For measuring the outer diameter of the supply roller 25, an automatic roller diameter measurement device "RM202" available from Apollo Seiko, Inc. is used. In a contact area C (see FIG. 8A) of the supply roller 25 with the indenter 71, the outer diameter is measured at nine locations at equal intervals in the axial direction and an average value thereof is calculated.

Thereafter, as described above, the indenter 71 is pushed into the conductive foam layer 25*a* at the push-in speed of 10 mm/min while the supply roller 25 is rotated at the rotational speed of 200 rpm (the circumferential speed of 136.1 mm/sec). After the push-in amount of the indenter 71 reaches 0.73 mm, the supply roller 25 is rotated for 250 seconds while maintaining the pushed amount, and then the indenter 71 is separated from the conductive foam layer 25*a* (step S203).

In this state, the weight of the supply roller 25 (hereinafter referred to as weight w2) is measured (step S204), and the outer diameter of the supply roller 25 (hereinafter referred to as outer diameter d2) is measured (step S205). The method of measuring the weight and the outer diameter of the supply roller 25 is as described in steps S201 and S202.

The weight loss (the amount of decrease in the weight) of the supply roller 25 (i.e., w1−w2) is calculated from the weights w1 and w2 of the supply roller 25, which are obtained in steps S201 and S204. The weight loss of the supply roller 25 reflects the amount of wear of the supply roller 25.

Also, from the outer diameters d1 and d2 of the supply roller 25 obtained in steps S202 and S205, the amount of decrease in the outer diameter of the supply roller 25 (i.e., d1−d2) is calculated. The amount of decrease in the outer diameter of the supply roller 25 reflects the amount of wear of the supply roller 25 and the degree of collapse of the cell walls (degree of wear).

<Printing Test>

Next, a printing test using the supply roller 25 is described. The printing test is conducted by the image formation apparatus 1 illustrated in FIG. 1 equipped with the process unit 2 incorporating the supply roller 25. The color LED printer "c542dn" available from OKI Data Corporation is used as the image formation apparatus 1. The resolution is set to 600 dpi.

In the printing test, a test pattern (described later) is printed by the magenta process unit 2M of the image formation apparatus 1. The process unit 2M is filled with about 30.0±0.5 grams of the magenta toner with an agglomeration of 48 to 58% and a blow-off charge of 75 to 80 μC/g A4 size printing paper called "P paper thick-grained" available from Fuji Xerox Corporation is used as the medium P. The medium P is fed in a vertical feed manner, in which the long side of the medium P is parallel to the conveyance direction, and the printing speed is set to 40 ppm (page per minute). The test environment is set at a temperature of 20 degrees Celsius (° C.) and a relative humidity of 50 percentage (%).

Under these conditions, a test pattern (a pattern for continuous printing) with a duty ratio of 0.3% is printed continuously on 2,500 sheets per day, and this is repeated for 20 days. That is, the pattern for continuous printing is printed on a total of 50,000 sheets (media P).

Figure 10:
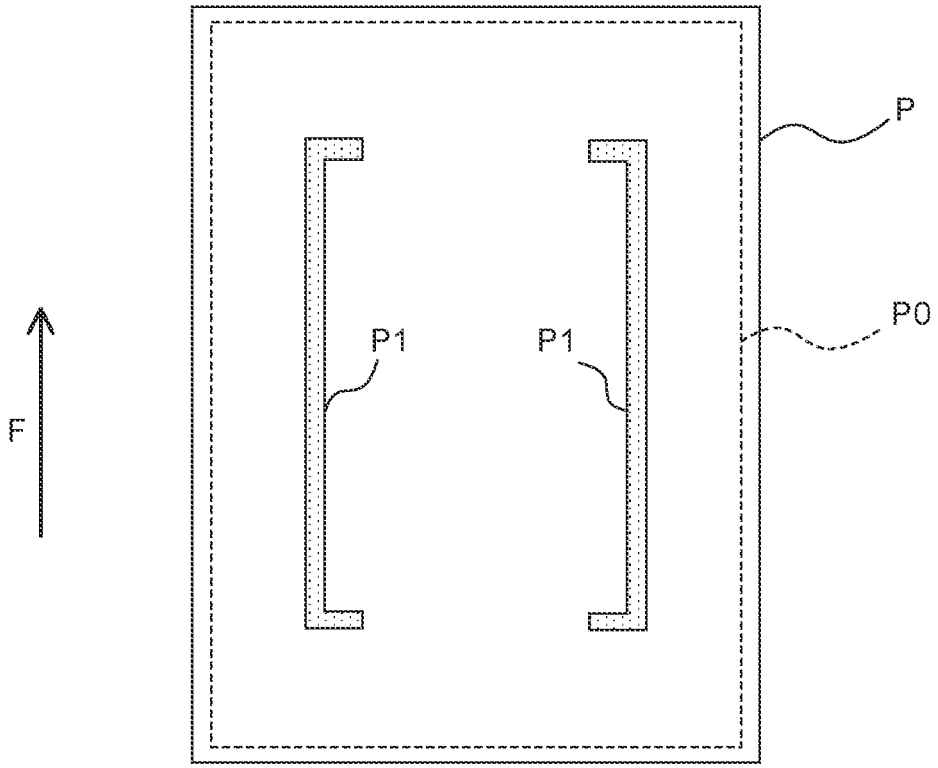
FIG. 10 is a diagram illustrating a schematic view of a pattern for continuous printing.

The pattern for continuous printing with the duty ratio of 0.3% is composed of two ruled lines P1 parallel to the conveyance direction of the medium P (indicated by the arrow F) formed in a printable area P0 of the medium P, as illustrated in FIG. 10.

The duty ratio, which is also referred to as a print image density, is defined as follows.

$$\text{Print image density(duty ratio)}=\{Cm(i)/(Cd\times C0)\}\times 100$$

In this formula, Cm (i) is the number of dots that the LED head 5 has emitted while the photosensitive drum 21 rotates Cd times (Cd rotations). C0 is the number of dots that the LED head 5 is capable of emitting during one rotation of the photosensitive drum 21. Cd×C0 is the number of dots that the LED head 5 is capable of emitting during the Cd rotations of the photosensitive drum 21.

That is, when a solid image is printed on the entire surface of the printable area P0 of the medium P, the print image density is 100%. If the image is printed with an area of 1% with respect to the print image density of 100%, the print image density is 1%.

Figure 11:
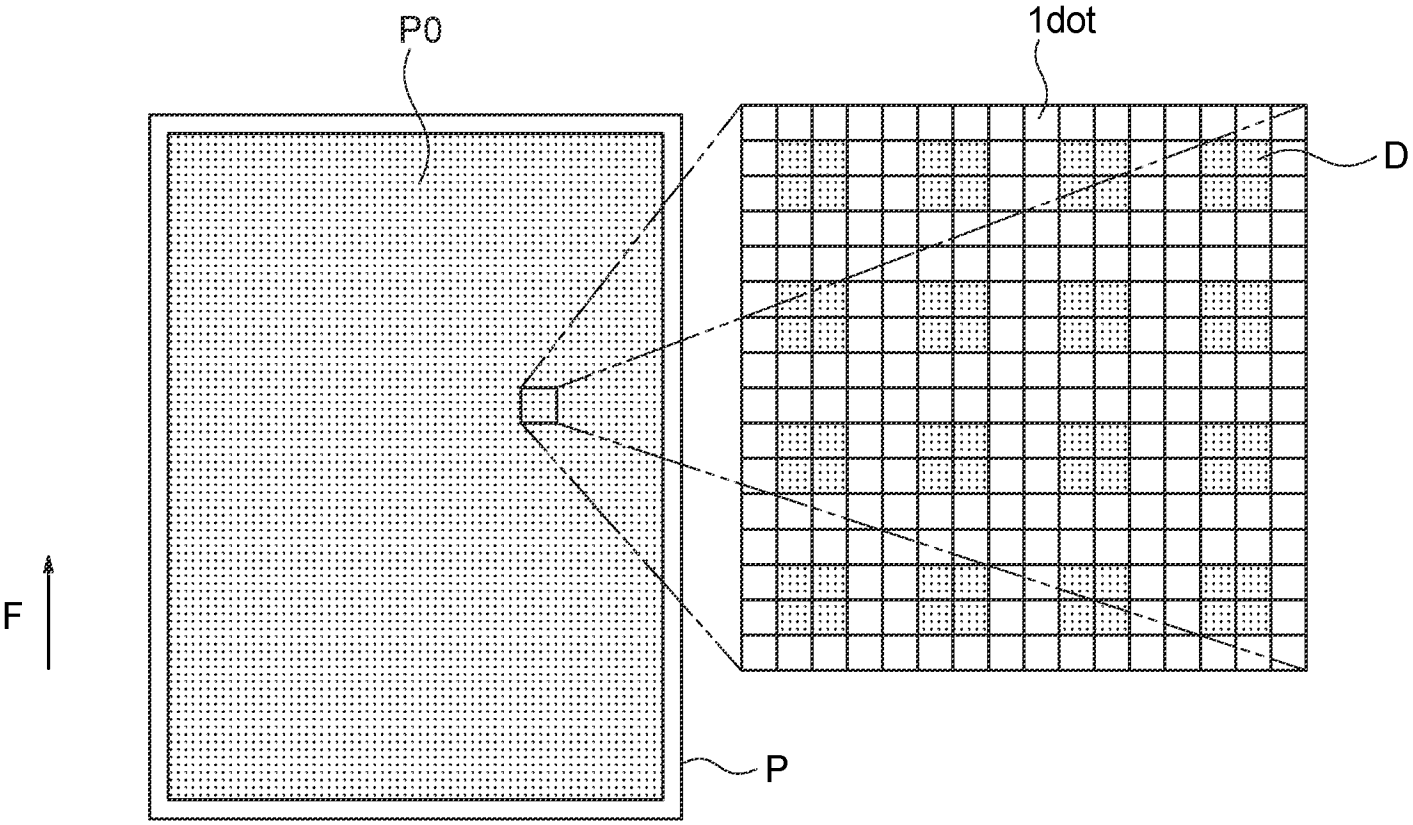
FIG. 11 is a diagram illustrating a view of an evaluation pattern.

After 20 days of the consecutive printing at 2500 sheets per day, an evaluation pattern illustrated in FIG. 11 is printed on a single sheet of the media P. A4 size Excellent White available from Oki Data Corporation is used as printing paper (medium P). The process unit, the toner, the feed direction of the medium P, the printing speed, and the test environment for printing the evaluation pattern are the same as in the continuous printing.

As illustrated in FIG. 11, the evaluation pattern is a 2×2 (halftone) pattern. In the 2×2 pattern (halftone pattern), four squares (four dots) composed by two dots vertically and two dots horizontally are formed in each set of sixteen squares (sixteen dots) composed by four dots vertically and four dots horizontally.

The evaluation pattern printed on the medium P is then visually observed to determine presence or absence of smudging (stains). The smudging is defined as any toner adhered to the white area in the medium P. This occurs because the residual toner on the development roller 23 (toner that have not been transferred to the photosensitive drum 21 and remains on the development roller 23) is not sufficiently scraped by the supply roller 25, causing the toner to be adhered to an area on the photosensitive drum 21 that are not to be developed.

If no smudging is observed during the 20-day visual observation of the evaluation pattern, the evaluation result is set to "good" (○). In contrast, if smudging is observed even in one day in the 20 days, the evaluation result is set to "poor" (X).

<Measurements of Cell Diameter, Cell Wall Thickness and Cell Area Ratio>

Next, a method for measuring the size of the cells 201 of the conductive foam layer 25*a* (cell diameter), the thickness of the cell walls 202 (cell wall thickness), and an area ratio of the cells 201 (cell area ratio) are described.

Figure 12:
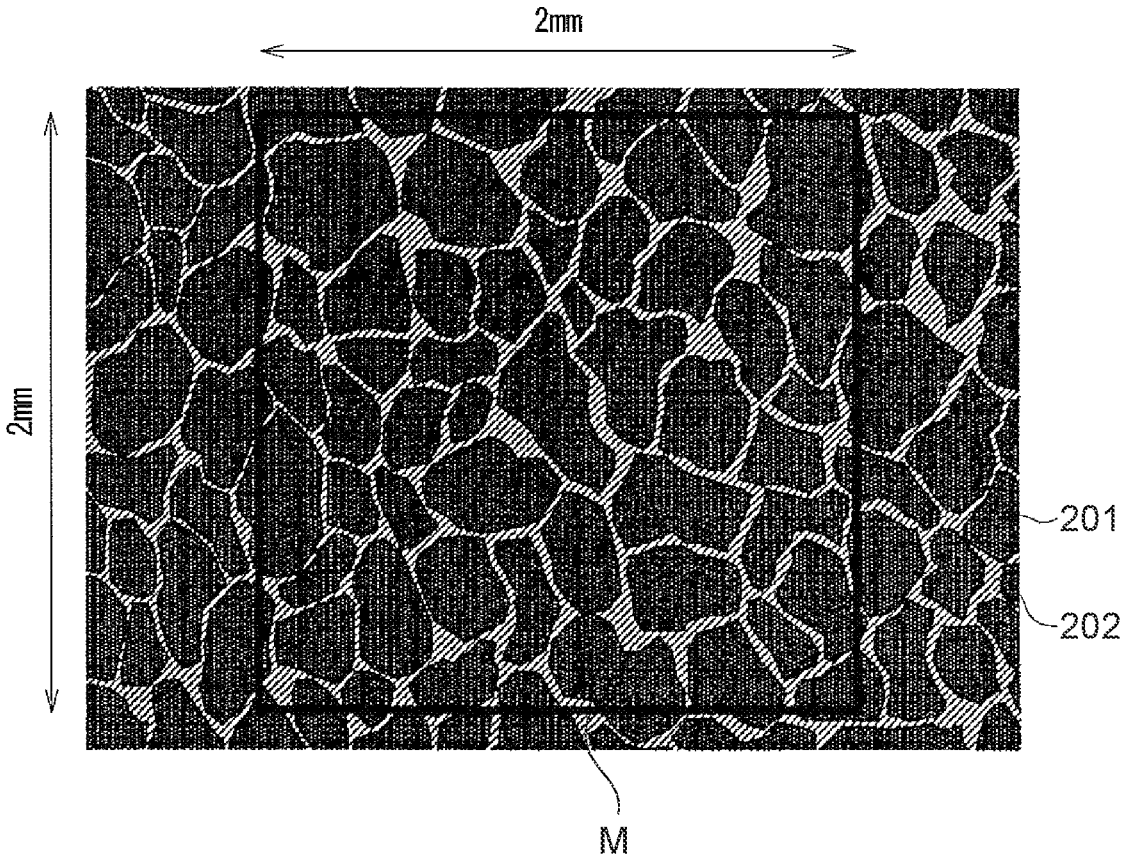
FIG. 12 is a diagram illustrating an enlarged view of a surface of the supply roller.

After manufacturing the supply roller 25 in the manner described in FIG. 5, a 2 mm square area M is observed with a digital microscope at any five locations on the surface of the conductive foam layer 25*a*. An example of an image observed in this observation is illustrated in FIG. 12. As illustrated in FIG. 12, the cells 201 and the cell walls 202 separating adjacent cells 201 from each other are seen.

The maximum size of the cells 201 (maximum cell diameter) in each area M is measured in the image observed by the digital microscope, and the average cell diameter in each area M is determined. Then, the average cell diameter of the five areas M is determined.

Similarly, the thicknesses of the walls between adjacent cells (i.e., cell walls 202) are measured in the image observed by the digital microscope, and the average thickness of the cell walls in each area M is determined. Then, the average cell wall thickness of the five areas M is determined.

From the images observed by the digital microscope, the occupancy (cell area ratio) of the area occupied by the cells 201 in each area M (4 $mm^2$) is measured, and the average of the cell area ratios of the five areas M is determined.

EXAMPLES

Next, Examples 1 to 7 according to an embodiment and Comparative Examples 1 to 9 with respect thereto are described.

(Example 1) As Example 1, a supply roller 25 including a conductive foam layer 25*a* is made. As a rubber material to form the conductive foam layer 25*a*, an additive reaction-type foam conductive silicone rubber composition is used.

Specifically, the additive reaction-type foam conductive silicone rubber composition is prepared by thoroughly mixing 70 mass parts of "KE-904FU" available from Shin-Etsu Chemical Co., Ltd. as a silicone foam rubber composition, 30 mass parts of "KE-87C40PU" available from Shin-Etsu Chemical Co., Ltd. as a conductive agent, 2 mass parts of "C-153A" available from Shin-Etsu Chemical Co., Ltd. as an addition reaction cross-linking agent, 5 mass parts of azobisisobutyronitrile as a foaming agent, 0.45 mass parts of platinum catalyst as an addition reaction catalyst, 0.5 mass parts of "R-153A" available from Shin-Etsu Chemical Co., Ltd. as a reaction control agent, and 2 mass parts of "C-3" available from Shin-Etsu Chemical Co., Ltd. as an organic peroxide cross-linking agent.

The supply roller 25 is made as follows. First, a core 25*b* is cleaned with toluene and then a primer is applied. A primer layer is then formed on the core 25*b* by firing the primer-coated core 25*b* at 150° C. and cooling it down to room temperature. Next, the above-mentioned additive reactive foam conductive silicone rubber composition is formed around the primer layer on the core 25*b*, using an extrusion molding machine, so as to form a solid rubber material. It is then heated (primary vulcanization) at 260° C. for 10 minutes, so as to be foam-crosslinked. After that, the foam-crosslinked addition-reactive foam conductive silicone rubber composition is heated (secondary vulcanization) at a temperature of 200° C. for 20 minutes and then left under the room temperature. Then, the conductive foam layer 25*a* formed in this way is polished until it is 3.5 mm thick. The conductive foam layer 25*a* is made straight (cylindrical) in shape and the outer diameter is 13 mm.

The result of the measurement using a digital microscope reveals that the cell diameter of the supply roller 25 in Example 1 is 405 μm, the cell wall thickness is 30.2 μm, and the cell area ratio is 58%.

The test piece 9 illustrated in FIG. 6 is prepared using the constituent material of the conductive foam layer 25*a* of the supply roller 25 in Example 1 (i.e., the additive reaction-type foam conductive silicone rubber composition described above). The tensile test in accordance with JIS-K6251 is performed on the test piece 9 of Example 1 and the tensile test reveals that the elongatedness is 81.6%/(N/mm$^2$).

Furthermore, a load rotation test described with reference to FIG. 7 is performed on the supply roller 25 of Example 1, and the load rotation test reveals that the repulsive force attenuation rate is 28%.

The wear test described with reference to FIGS. 8 and 9 is performed on the supply roller 25 of Example 1, and the wear test reveals that the decrease in the outer diameter is 0.03 mm and the decrease in the weight is 0.07 grams.

When the continuous printing (2500 sheets per day for 20 days) and the printing of the evaluation pattern (one sheet per day for 20 days) as described above are performed by the image formation apparatus 1 equipped with the process unit 2M including the supply roller 25 of Example 1, no smudging is observed even once throughout the 20 days.

(Example 2) As Example 2, a supply roller 25 including a conductive foam layer 25*a* is prepared with an amount of the foaming agent added being different from Example 1 and otherwise using the same method as in Example 1. In the supply roller 25 of Example 2, the cell diameter is 380 μm, the cell wall thickness is 29.4 μm, and the cell area ratio is 56%.

The elongatedness obtained by the tensile test is 81.6%/(N/mm$^2$) and as a result of a result of the load rotation test, the repulsive force attenuation is 31%. As a result of the wear test, the decrease in the outer diameter is 0.03 mm and the weight loss is 0.06 grams. As a result of the printing test, no smudging is observed on the evaluation patterns.

(Example 3) As Example 3, a supply roller 25 including a conductive foam layer 25*a* is prepared with an amount of the foaming agent added being different from Example 1 and otherwise using the same method as in Example 1. In the supply roller 25 of Example 3, the cell diameter is 394 μm, the cell wall thickness is 31.4 μm, and the cell area ratio is 60%.

The elongatedness obtained by the tensile test is 72.6%/(N/mm$^2$) and the repulsive force attenuation rate obtained by the load rotation test is 27%. As a result of the wear test, the decrease in the outer diameter is 0.02 mm and the weight loss is 0.07 grams. As a result of the printing test, no smudging is observed on the evaluation patterns.

(Example 4) As Example 4, a supply roller 25 including a conductive foam layer 25*a* is prepared with an amount of the foaming agent added being different from Example 1 and otherwise using the same method as in Example 1. In the supply roller 25 of Example 4, the cell diameter is 434 μm, the cell wall thickness is 27.9 μm, and the cell area ratio is 57%.

The elongatedness obtained by the tensile test is 72.6%/(N/mm$^2$) and the repulsive force attenuation rate obtained by the load rotation test is 31%. As a result of the wear test, the decrease in the outer diameter is 0.02 mm and the weight loss is 0.04 grams. As a result of the printing test, no smudging is observed on the evaluation patterns.

(Example 5) As Example 5, a supply roller 25 including a conductive foam layer 25*a* is prepared with an amount of the foaming agent added being different from Example 1 and otherwise using the same method as in Example 1. In the supply roller 25 of Example 5, the cell diameter is 472 μm, the cell wall thickness is 32.2 μm, and the cell area ratio is 56%.

The elongatedness obtained by the tensile test is 72.6%/(N/mm$^2$) and the repulsive force attenuation rate obtained by the load rotation test is 31%. As a result of the wear test, the decrease in the outer diameter is 0.03 mm and the weight loss is 0.05 grams. As a result of the printing test, no smudging is observed on the evaluation patterns.

(Example 6) As Example 6, a supply roller 25 including a conductive foam layer 25*a* is prepared with an amount of the foaming agent added being different from Example 1 and otherwise using the same method as in Example 1. In the supply roller 25 of Example 6, the cell diameter is 480 μm, the cell wall thickness is 33.0 μm, and the cell area ratio is 54%.

The elongatedness obtained by the tensile test is 75.6%/(N/mm$^2$) and the repulsive force attenuation rate obtained by the load rotation test is 29%. As a result of the wear test, the decrease in the outer diameter is 0.03 mm and the weight loss is 0.05 grams. As a result of the printing test, no smudging is observed on the evaluation patterns.

(Example 7) As Example 7, a supply roller 25 including a conductive foam layer 25*a* is prepared with an amount of the foaming agent added being different from Example 1 and otherwise using the same method as in Example 1. In the supply roller 25 of Example 7, the cell diameter is 396 μm, the cell wall thickness is 25.3 μm, and the cell area ratio is 59%.

The elongatedness obtained by the tensile test is 72.6%/(N/mm$^2$) and the repulsive force attenuation rate obtained by the load rotation test is 28%. As a result of the wear test, the decrease in the outer diameter is 0.02 mm and the weight loss is 0.06 grams. As a result of the printing test, no smudging is observed on the evaluation patterns.

(Comparative Example 1) As Comparative Example 1, a supply roller 25 with a conductive foam layer 25*a* is prepared with an amount of the foaming agent added being different from Example 1 and otherwise using the same method as in Example 1. In the supply roller 25 of Comparative Example 1, the cell diameter is 284 μm, the cell wall thickness is 26.2 μm, and the cell area ratio is 64%.

The elongatedness obtained by the tensile test is 65.8%/(N/mm$^2$) and the repulsive force attenuation rate of the load rotation test is 24%. As a result of the wear test, the decrease in the outer diameter is 0.05 mm and the weight loss is 0.31 grams. Also, as a result of the printing test, smudging is observed on the evaluation patterns.

(Comparative Example 2) As Comparative Example 2, a supply roller 25 including a conductive foam layer 25*a* is prepared with an amount of the foaming agent added being different from Example 1 and otherwise using the same method as in Example 1. In the supply roller 25 of Comparative Example 2, the cell diameter is 263 μm, the cell wall thickness is 24.7 μm, and the cell area ratio is 60%.

The elongatedness obtained by the tensile test is 61.8%/(N/mm$^2$) and the repulsive force attenuation rate of the load rotation test is 26%. As a result of the wear test, the decrease in the outer diameter is 0.05 mm and the weight loss is 0.30 grams. Also, as a result of the printing test, smudging is observed on the evaluation patterns.

(Comparative Example 3) As Comparative Example 3, a supply roller 25 including a conductive foam layer 25*a* is prepared with an amount of the foaming agent added being different from Example 1 and otherwise using the same method as in Example 1. In the supply roller 25 of Comparative Example 3, the cell diameter is 278 μm, the cell wall thickness is 25.9 μm and the cell area ratio is 61%.

The elongatedness obtained by the tensile test is 69.4%/(N/mm$^2$) and the repulsive force attenuation rate obtained by the load rotation test is 27%. As a result of the wear test, the decrease in the outer diameter is 0.06 mm and the weight loss is 0.20 grams. Also, as a result of the printing test, smudging is observed on the evaluation patterns.

(Comparative Example 4) As Comparative Example 4, a supply roller 25 including a conductive foam layer 25*a* is prepared with an amount of the foaming agent added being different from Example 1 and otherwise using the same method as in Example 1. In the supply roller 25 of Comparative Example 4, the cell diameter is 573 μm, the cell wall thickness is 23.3 μm, and the cell area ratio is 48%.

The elongatedness obtained by the tensile test is 87.0%/(N/mm$^2$) and the repulsive force attenuation rate obtained by the load rotation test is 33%. As a result of the wear test, the decrease in the outer diameter is 0.05 mm and the weight loss is 0.01 grams. Also, as a result of the printing test, smudging is observed on the evaluation patterns.

(Comparative Example 5) As Comparative Example 5, a supply roller 25 including a conductive foam layer 25*a* is prepared with the amount of the foaming agent added being different from Example 1 and otherwise using the same method as in Example 1. In the supply roller 25 of Comparative Example 5, the cell diameter is 479 μm, the cell wall thickness is 18.5 μm and the cell area ratio is 45%.

The elongatedness obtained by the tensile test is 91.2%/(N/mm$^2$) and the repulsive force attenuation rate obtained by the load rotation test is 34%. As a result of the wear test, the decrease in the outer diameter is 0.06 mm and the weight loss is 0.02 grams. Also, as a result of the printing test, smudging is observed on the evaluation patterns.

(Comparative Example 6) As Comparative Example 6, a supply roller 25 including a conductive foam layer 25*a* is prepared with the amount of the foaming agent added being different from Example 1 and otherwise using the same method as in Example 1. In the supply roller 25 of Comparative Example 6, the cell diameter is 504 μm, the cell wall thickness is 22.8 μm, and the cell area ratio is 47%.

The elongatedness obtained by the tensile test is 85.8%/(N/mm$^2$) and the repulsive force attenuation rate obtained by the load rotation test is 36%. As a result of the wear test, the decrease in the outer diameter is 0.05 mm and the weight loss is 0.04 grams. Also, as a result of the printing test, smudging is observed on the evaluation patterns.

(Comparative Example 7) As Comparative Example 7, a supply roller 25 including a conductive foam layer 25*a* is prepared with the amount of the foaming agent added being different from Example 1 and otherwise using the same method as in Example 1. In the supply roller 25 of Comparative Example 7, the cell diameter is 313 μm, the cell wall thickness is 24.6 μm, and the cell area ratio is 64%.

The elongatedness obtained by the tensile test is 65.8%/(N/mm$^2$) and the repulsive force attenuation rate obtained by the load rotation test is 30%. As a result of the wear test, the decrease in the outer diameter is 0.07 mm and the weight loss is 0.21 grams. Also, as a result of the printing test, smudging is observed on the evaluation patterns.

(Comparative Example 8) As Comparative Example 8, a supply roller 25 with a conductive foam layer 25*a* is prepared with an amount of the foaming agent added being different from Example 1 and otherwise using the same method as in Example 1. In the supply roller 25 of Comparative Example 8, the cell diameter is 330 μm, the cell wall thickness is 22.9 μm, and the cell area ratio is 62%.

The elongatedness obtained by the tensile test is 61.8%/(N/mm$^2$) and the repulsive force attenuation rate obtained by the load rotation test is 31%. As a result of the wear test, the decrease in the outer diameter is 0.06 mm and the weight loss is 0.22 grams. Also, as a result of the printing test, smudging is observed on the evaluation patterns.

(Comparative Example 9) As Comparative Example 9, a supply roller 25 including a conductive foam layer 25*a* is prepared with an amount of the foaming agent added being different from Example 1 and otherwise using the same method as in Example 1. In the supply roller 25 of Comparative Example 9, the cell diameter is 369 μm, the cell wall thickness is 24.3 μm, and the cell area ratio is 61%.

The elongatedness obtained by the tensile test is 69.4%/(N/mm$^2$) and the repulsive force attenuation rate obtained by the load rotation test is 33%. In the result of the wear test, the decrease in the outer diameter is 0.06 mm and the decrease in the weight is 0.19 grams. Also, as a result of the printing test, smudging is observed on the evaluation patterns.

FIG. 13 is a table illustrating the evaluation results on the supply rollers 25 of Examples 1 to 7 and Comparative Examples 1 to 9.

<Relationship Between Characteristics of Supply Roller and Printing Result>

As described above, no smudging is observed on the printed image (printed evaluation patterns) when the supply roller 25 of Examples 1 to 7 is used, whereas smudging is observed on the printed image when the supply roller 25 of Comparative Examples 1 to 9 is used.

In Examples 1 to 7, the elongatedness is 72.6 to 81.6%/(N/mm$^2$), the repulsive force attenuation rate is 27 to 31%, the decrease in the outer diameter is less than 0.03 mm, and the decrease in the weight is less than 0.07 grams.

On the other hand, in Comparative Examples 1-3 and 7-9, the elongatedness is less than 72.6%/(N/mm$^2$), the decrease in the outer diameter exceeds 0.03 mm, and the decrease in the weight exceeds 0.07 grams. That is, in Comparative Examples 1 to 3 and 7 to 9, the elongatedness of the rubber material to form the conductive foam layer 25*a* is too low, so that when the supply roller 25 rotates with being in contact with the developer roller 23, the supply roller 25 is less likely to be deformed in the direction of rotation, and therefore the cell walls 202 are likely to be broken. In other words, the wear amount of the supply roller 25 is large. As a result, both the decrease in the outer diameter and the decrease in the weight of the supply roller 25 due to the wear test are large.

Because of the large amount of wear on the supply roller 25, when continuous printing is performed, the contact pressure (nip pressure) between the supply roller 25 and the developer roller 23 decreases, and the capacity of the supply roller 25 to scrape off the toner from the developer roller 23 is reduced, which may cause smudging in the printed image.

In Comparative examples 4 to 6, the elongatedness exceeds 81.6%/(N/mm$^2$) and the repulsive force attenuation rate exceeds 31%. In Comparative examples 4 to 6, the weight loss is less than 0.07 grams, but the decrease in the outer diameter is more than 0.03 mm. In other words, in Comparative Examples 4 to 6, the elongatedness of the rubber material forming the conductive foam layer 25*a* is too large, so that the supply roller 25 is easily deformed in the direction of rotation when the supply roller 25 rotates with being in contact with the developer roller 23. That is, although the wear amount on the supply roller 25 is small, the cell walls 202 are easily tilted (collapsed, dent) in the direction of rotation. As a result, in the wear test, the decrease in the weight of the supply roller 25 is small but the decrease in the outer diameter is large.

Since the supply roller 25 is easily deformed in the direction of rotation, when continuous printing is performed, the cell walls 202 in the supply roller 25 collapses in the direction of rotation, reducing the capacity of the supply roller 25 to scrape off the toner, which may cause smudging in the printed image.

Figure 14:
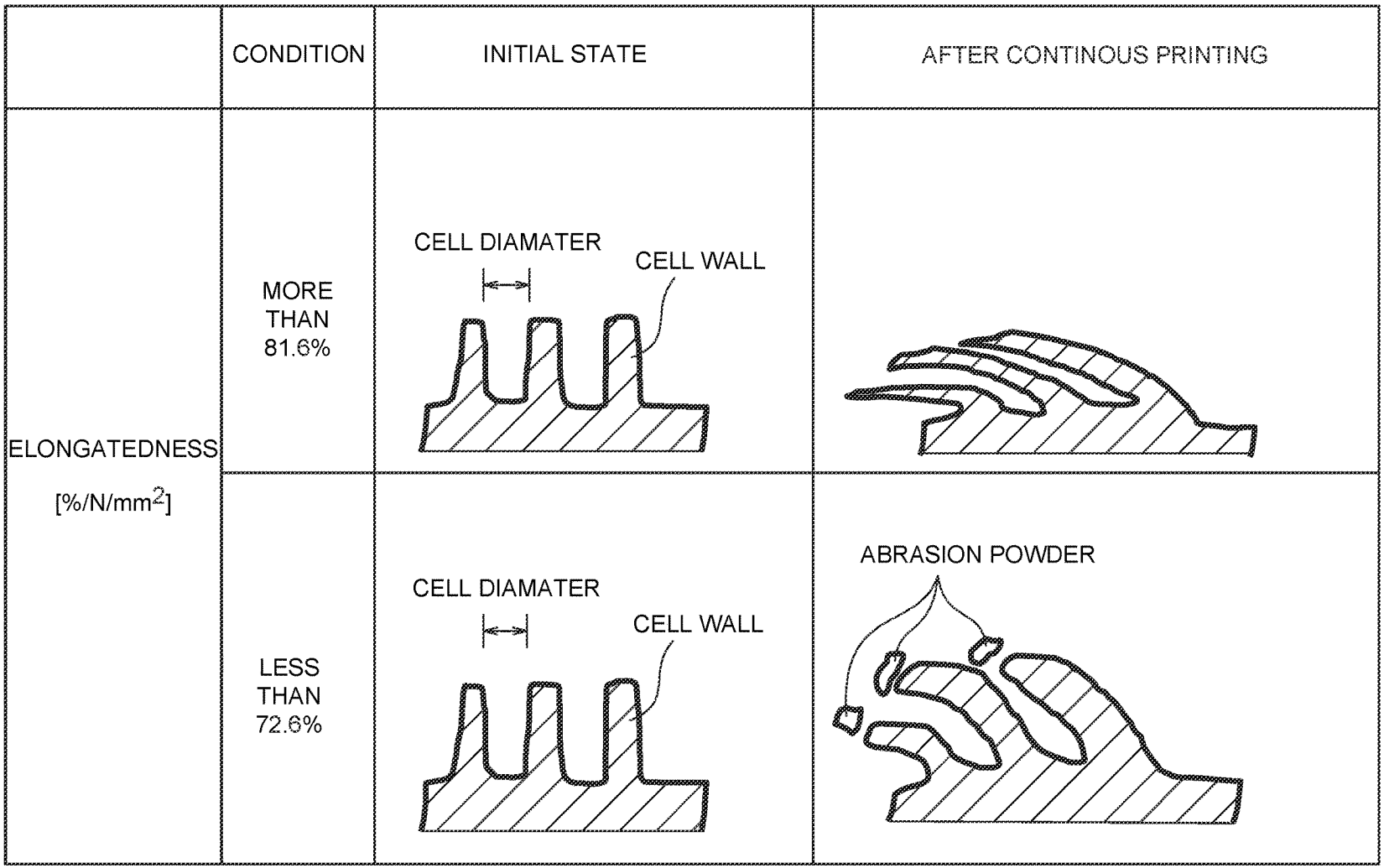
FIG. 14 is a diagram illustrating a relationship between an elongatedness and cell shapes of the supply roller.

FIG. 14 schematically illustrates the relationship between the elongatedness of the constituent material of the conductive foam layer 25*a* of the supply roller 25 and the initial state of the cells 201 and the state of the cells 201 after continuous printing. When the elongatedness is less than 72.6%/(N/mm$^2$), the conductive foam layer 25*a* is not easily deformed, causing damages to the cell walls 202 and an increase in the wear amount, and reducing the nip pressure between the supply roller 25 and the development roller 23. As a result, the capacity of the supply roller 25 to scrape off the toner is reduced, causing smudging in the printed image.

When the elongatedness exceeds 81.6%/(N/mm$^2$), the conductive foam layer 25*a* is easily deformed and the cell walls 202 are easily collapsed in the direction of rotation. This reduces the capacity of the supply roller 25 to scrape off the toner and causes smudging in the printed image. Based on these results, it is preferable that the elongatedness of the rubber material of the conductive foam layer 25*a* of the supply roller 25 is from 72.6 to 81.6%/(N/mm$^2$).

Figure 15:
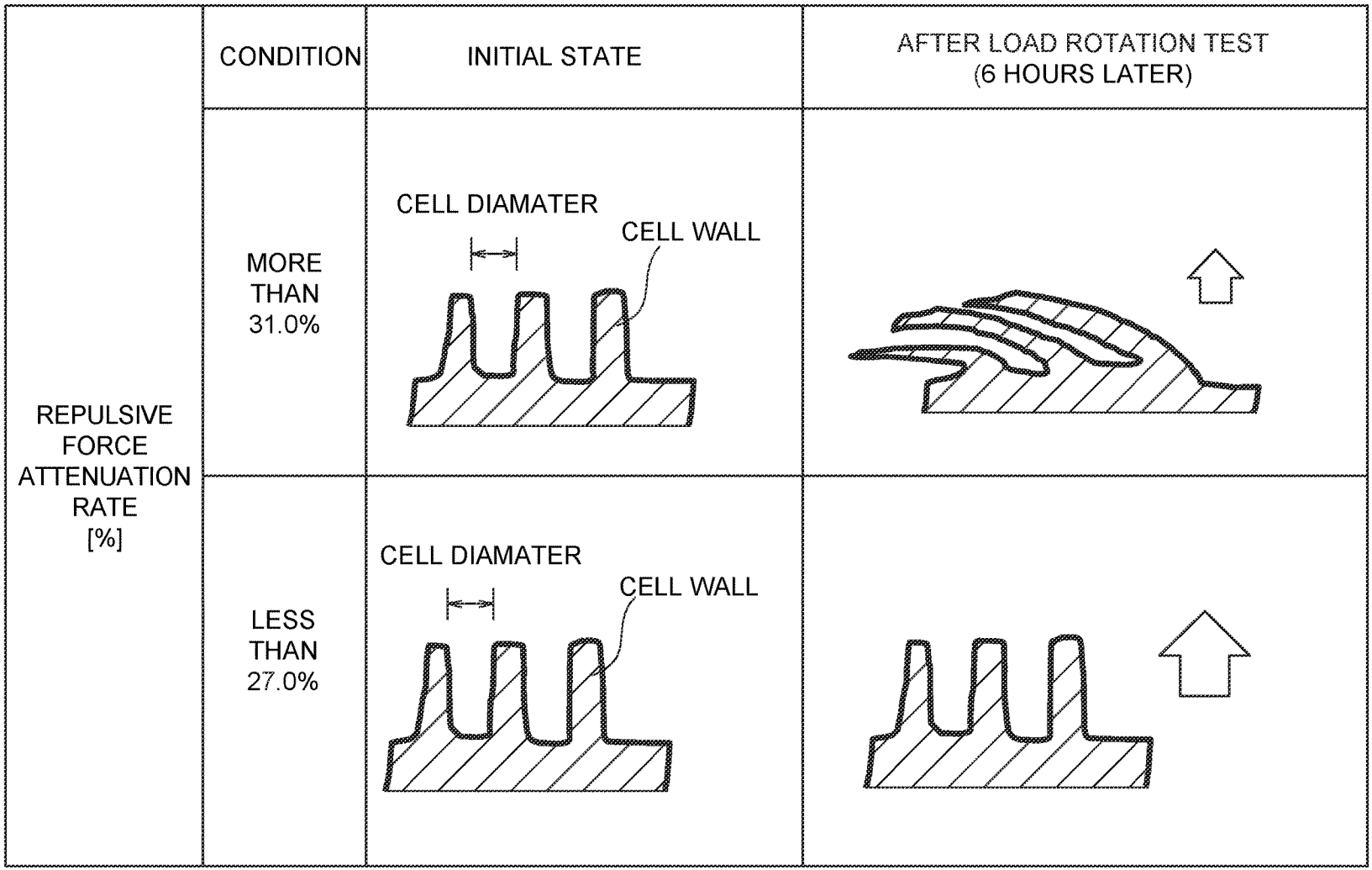
FIG. 15 is a diagram illustrating a relationship between a repulsive force attenuation rate and cell shapes of the supply roller.

FIG. 15 schematically illustrates the relationship between the repulsive force attenuation rate of the conductive foam layer 25*a* of the supply roller 25 and the initial state of the cells and the state of the cells after the load rotation test. When the repulsive force attenuation rate is less than 27%, the conductive foam layer 25*a* is not easily deformed and thus the load on the development roller 23 is increased. As a result, a filming phenomenon occurs on the surface of the development roller 23, which may cause printing defects.

When the repulsive force attenuation rate exceeds 31%, the portion of the conductive foam layer 25*a* that is pushed in is difficult to return to its original shape (i.e., the recovery of shape due to the elastic restorative force is slow), and thus the cell walls 202 are likely to be collapsed in the direction of rotation. This may reduce the capacity of the supply roller 25 to scrape off the toner and cause smudging in the printed image. Based on these results, it is preferable that the repulsive force attenuation rate of the conductive foam layer 25*a* of the supply roller 25 is not less than 27% and not more than 31%.

However, in Comparative Examples 3, 7, and 8, the repulsive force attenuation rate is within the range of 27 to 31%, but smudging is observed in the printed images. Therefore, it is preferable to have the repulsive force attenuation rate of 27 to 31%, in the case where the elongatedness is 72.6 to 81.6%/(N/mm$^2$) or the decrease in the outer diameter is not less than 0.03 mm.

The decrease in the outer diameter of the supply roller 25 in the wear test reflects both the wear of the conductive foam layer 25*a* of the supply roller 25 and the collapse of the cell walls 202. If the decrease in the outer diameter exceeds 0.03 mm, the wear of the conductive foam layer 25*a* or the collapse of the cell walls reduces the capacity to scrape off the residual toner from the surface of the development roller 23 and causes smudging in the printed image. Therefore, it is preferable that the decrease in the outer diameter of the supply roller 25 in the wear test is 0.03 mm or more.

The amount of decrease in weight of the supply roller 25 in the wear test reflects the wear of the conductive foam layer 25*a* of the supply roller 25. When the decrease in the weight of the supply roller 25 exceeds 0.07 grams, the capacity to scrape the residual toner off the surface of the development roller 23 is reduced due to the wear of the conductive foam layer 25*a*, causing smudging in the printed image. Therefore, it is preferable that the decrease in the weight of the supply roller 25 in the wear test is 0.07 grams or more.

However, in Comparative Examples 4 to 6, the decrease in the weight of the supply roller 25 is not more than 0.07 grams, but smudging is observed in the printed images. Therefore, it is preferable that the decrease in the weight of the supply roller 25 is 0.07 grams or less, in the case where the elongatedness is from 72.6 to 81.6%/(N/mm$^2$) or the amount of the decrease in outer diameter is 0.03 mm or more.

As mentioned above, it is preferable that the conductive foam layer 25*a* of the supply roller 25 contains the silicone rubber as the main component thereof. This is because if the silicone rubber is the main component of the conductive foam layer 25*a*, the cells in the conductive foam layer 25*a* are independent air cells.

A sample in a shape of squire with each side of 1 cm is cut from the conductive foam layer 25*a* of the supply roller 25 and analyzed by FT-IR (Fourier Transform Infrared Spectroscopy). The range of the FT-IR analysis is 400 to 4000 cm$^{-1}$ wavenumbers.

Figure 16:
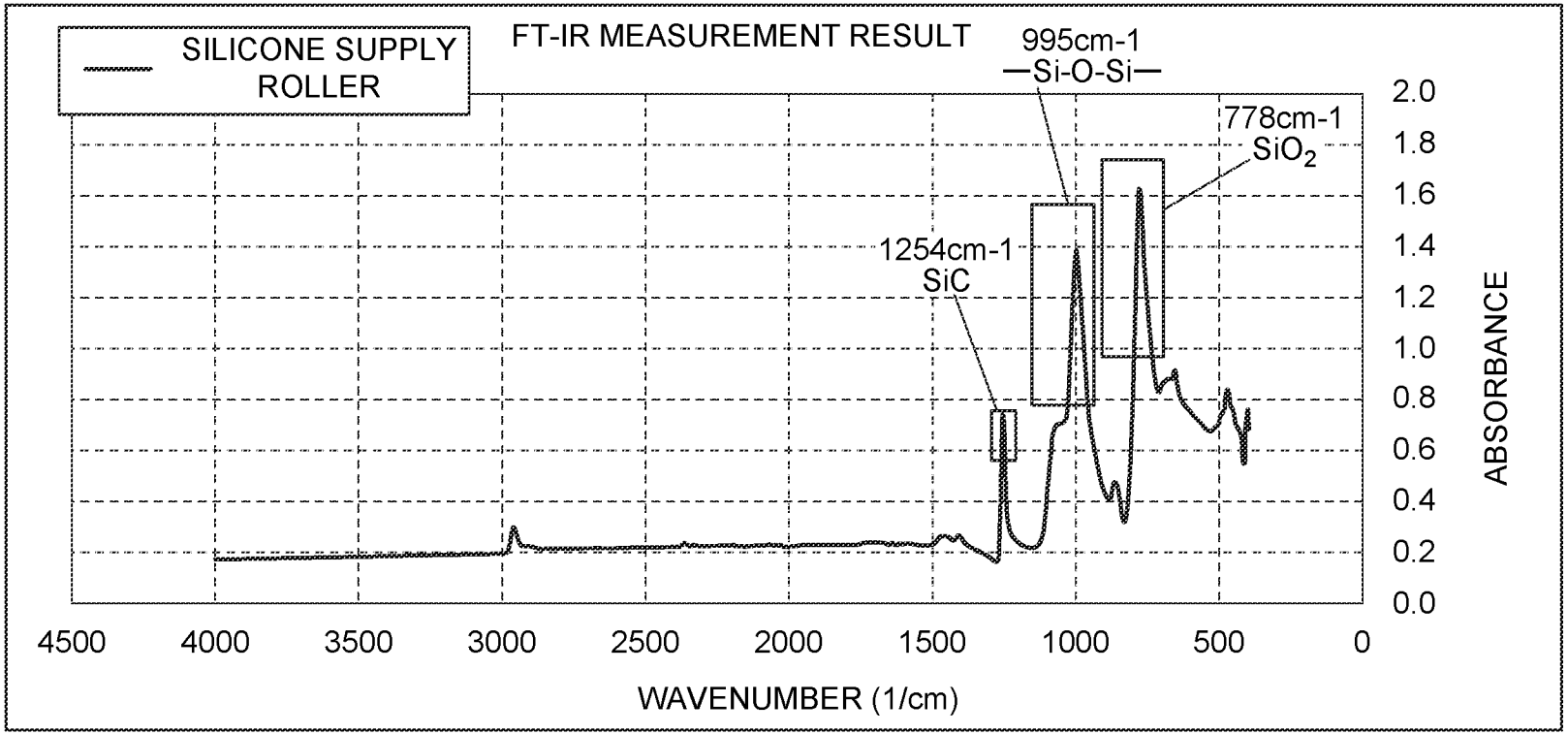
FIG. 16 is a diagram illustrating results of FT-IR analysis on a silicone rubber supply roller.

FIG. 16 illustrates the spectral intensity distribution obtained by the FT-IR (Fourier Transform Infrared Spectroscopy) analysis on the conductive foam layer 25*a* made of silicone rubber. In FIG. 16, the peak of $SiO_2$ is seen at wavenumber 778 cm$^{-1}$, the peak of Si—O—Si is seen at wavenumber 995 cm$^{-1}$, and the peak of SiC is seen at wavenumber 1254 cm$^{-1}$.

Figure 17:
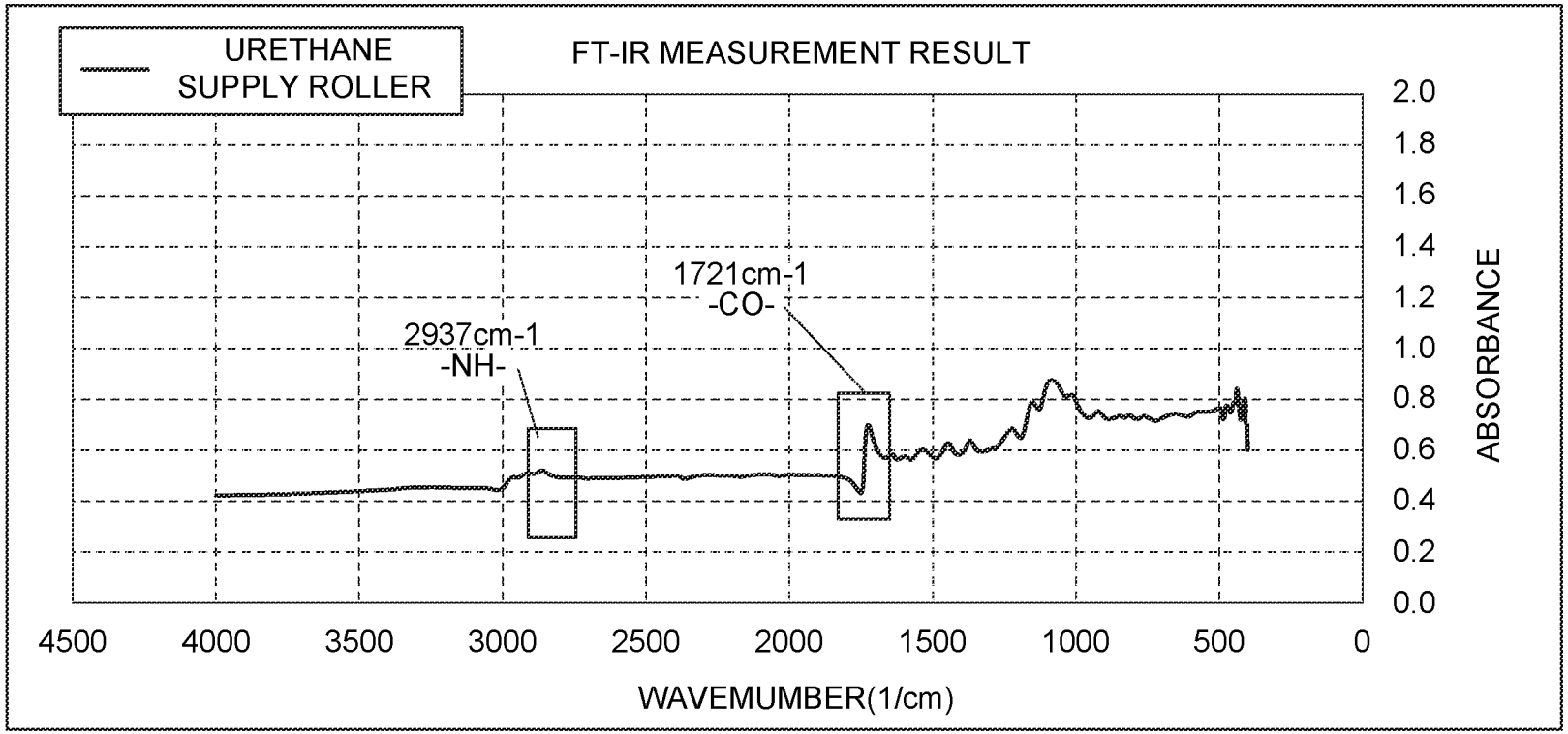
FIG. 17 is a diagram illustrating results of FT-IR analysis on a urethane rubber supply roller.

FIG. 17 illustrates a spectral intensity distribution obtained by the FT-IR analysis on the conductive foam layer 25*a* made of urethane rubber. In FIG. 17, the peak of CO is seen at wave number 1721 cm$^{-1}$ and the peak of NH is seen at wave number 2937 cm$^{-1}$.

The conductive foam layer 25*a* of the supply roller 25 may contain the silicone rubber and other substances (e.g., urethane rubber), as long as the silicone rubber is contained 50% or more as the main component.

From the above description, it is preferable that, in order to obtain a good printed image, the supply roller 25 satisfies the following. (A) The elongatedness obtained by tensile testing (JIS-K6251) of the rubber material (after vulcanization and before the foaming process) of the conductive foam layer 25*a* of the supply roller 25 is 72.6 to 81.6 (%/(N/mm$^2$)). (B) The attenuation rate (%) of the repulsive force of the supply roller 25 obtained in the load wear test is 27% to 31%. (C) The decrease in the outer diameter of the supply roller 25 in the wear test is 0.03 mm or less. (D) The decrease in the weight of the supply roller 25 in the wear test is 0.07 grams or less.

If at least one of (A) and (C) of (A) to (D) is satisfied, the reduction in the capacity of the supply roller 25 to scrape the toner can be suppressed and the image quality can be improved. If at least one of (B) and (C) is further satisfied in addition to at least one of (A) and (C), the effect of suppressing the deterioration of the toner scraping capacity can be enhanced and the image quality can be further improved.

Effects of Embodiments

As described above, the process unit 2 (development unit) according to an embodiment includes: the development roller (developer carrier) 23 configured to develop the latent image by supplying the toner (developer) to the photosensitive drum 21 (image carrier); and the supply roller (developer supply member) 25 configured to supply the toner to the development roller 23. The supply roller 25 is arranged in contact with the development roller 23 and includes a conductive foam layer (elastic layer) 25*a* on the surface of the supply roller 25. In an embodiment, when the wear test is conducted in which the supply roller 25 is rotated at the circumferential speed of 136.1 mm/sec in the state where the stainless steel indenter 71 having the thickness of 10 mm is pressed into the conductive foam layer 25*a* of the supply roller 25 by 0.73 mm in such a manner that the rapping film 72 fixed on the surface 71*a* (50 mm squire) of the indenter 71 is in press contact with the surface of the conductive foam layer 25*a*, the decrease in the outer diameter of the supply roller 25 in the wear test, which is obtained by subtracting the value of the outer diameter of the supply roller 25 when the indenter 71 is separated 250 seconds after the pushed-in amount of the indenter 71 reaches 0.73 mm from the value of the outer diameter of the supply roller 25 before the indenter 71 is pushed in is 0.03 mm or less. As a result, the wear of the supply roller 25 or collapse (denting) of the cell walls in the supply roller 25 can be suppressed, and the decrease in the toner scraping capacity can be suppressed. This can suppress the occurrence of smudging of the printed image and improve the image quality.

Further, in an embodiment, when the wear test is performed, the decrease in the weight of the supply roller 25 when the indenter 71 is released 250 seconds after the indenter 71 has reached 0.73 mm, is less than 0.07 grams. As a result, the wear of the supply roller 25 can be suppressed and the decrease in the toner scraping capacity can be suppressed. This can suppress the occurrence of smudging in the printed image and improve the image quality.

When the tensile test in accordance with JIS-K6251 is conducted on the test piece 9 which is formed from the material after the vulcanization and before the foaming treatment of the conductive foam layer 25*a* (elastic layer) of the supply roller 25 and formed in the shape of the dumbbell No. 1, the value (i.e., elongatedness) obtained by dividing the elongation rate E (%) at the time when the test piece 9 is broken by the stress ($N/mm^2$) at the time when the test piece 9 is broken is not less than 72.6 and not more than 81.6%/($N/mm^2$). As a result, the wear of the supply roller 25 can be suppressed and the collapse (denting) of the cell walls can be suppressed, so as to suppress the decrease in the toner scraping capacity of the supply roller 25. This can suppress the occurrence of smudging in the printed image and improve the image quality.

In a case where the supply roller 25 is rotated for six hours at the circumferential speed of 136.1 mm/second in a state where the cylindrical stainless steel indenter 81 with the outer diameter of 16 mm and the axial length of 50 mm is pressed into the conductive foam layer 25*a* of the supply roller 25 by 0.73 mm, a rate of decrease (i.e., a rate of attenuation) from the repulsive force of the conductive foam layer 25*a* before the indenter 81 is pressed into the conductive foam layer 25*a* to the repulsive force of the conductive foam layer 25*a* six hours after the amount of the indenter 81 pressed into the supply roller 25 reaches 0.73 mm is not less than 27% and not more than 31%. As a result, the wear of the supply roller 25 can be suppressed and the collapse (denting) of the cell walls can be suppressed, so as to suppress the decrease in the toner scraping capacity of the supply roller 25. This can suppress the occurrence of smudging in the printed image and improve the image quality. Furthermore, an excessive contact pressure between the supply roller 25 and the development roller 23 can be prevented, thereby reducing the occurrence of filming.

Although one or more embodiments described above describe the electrophotographic printer, the invention is not limited to this, but may be applied to for example, an electrophotographic facsimile machine, a copier, an MFP (Multi-Function Peripheral), or the like.

Although one or more preferred embodiments have been described above, the invention is not limited thereto, and various improvements or modifications can be made without departing from the gist of the invention. The invention includes other embodiments or modifications in addition to the above-described one or more embodiments without departing from the spirit of the invention. The one or more embodiments described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development unit comprising:

a developer carrier configured to supply an image carrier with a developer to develop a latent image on the image carrier with the developer; and a developer supply member including an elastic layer on a surface thereof, disposed to be in contact with the developer carrier, and configured to supply the developer to the developer carrier, wherein the elastic layer comprises a conductive foam layer containing silicone rubber as a main component that accounts for 50% or more by weight of an entirety of the elastic layer, thicknesses of walls dividing cells in the conductive foam layer are not less than 25.3 μm and not more than 32.2 μm, inner diameters of the cells are not less than 380 μm and not more than 480 μm, and an area percentage of the cells on a surface of the conductive foam layer is not less than 54% and not more than 60%.

2. The development unit according to claim 1, wherein wear characteristics of the developer supply member are such that, the developer supply member is rotated at a circumferential speed of 136.1 mm/second in a state in which a stainless steel indenter is pressed into the elastic layer of the developer supply member by 0.73 mm in such a manner that an abrasive film is in press contact with a surface of the elastic layer, and an amount of decrease in weight of the developer supply member, which is obtained by subtracting a value of the weight of the developer supply member before the indenter is pressed from a value of the weight of the developer supply member when the indenter is released from the developer supply member 250 seconds after an amount of the indenter pressed into the developer supply member reaches 0.73 mm, is 0.07 grams or less.

3. The development unit according to claim 1, wherein wear characteristics of the developer supply member are such that the developer supply member is rotated for six hours at a circumferential speed of 136.1 mm/sec in a state in which a cylindrical stainless steel indenter with an outer diameter of 16 mm and an axial length of 50 mm is pressed into the elastic layer by 0.73 mm, and a rate of decrease from a repulsive force of the elastic layer before the indenter is pressed into the elastic layer to a repulsive force of the elastic layer six hours after an amount of the indenter pressed into the developer supply member reaches 0.73 mm is not less than 27% and not more than 31%.

4. The development unit according to claim 1, wherein an Asker F hardness of the elastic layer is greater than or equal to 40 and less than or equal to 46.

5. An image formation apparatus comprising:

the development unit according to claim 1;

a transfer unit that transfers a developer image formed on the image carrier to a medium; and a fixation unit that fixes the developer image transferred to the medium to the medium.

6. The development unit according to claim 1, wherein an elongatedness of the developer supply member is such that in a case in which a tensile test in accordance with JIS-K6251 is conducted on a test piece that is formed from a material after vulcanization and before foaming of the elastic layer and formed in a shape of a dumbbell No. 1, a value obtained by dividing an elongation rate % of the test piece at a time when the test piece is broken by a stress $N/mm^2$ at the time when the test piece is broken is not less than 72.6 and not more than 81.6.

7. The development unit according to claim 6, wherein an attenuation rate of the developer supply member is such that in a case where the developer supply member is rotated for six hours at a circumferential speed of 136.1 mm/sec in a state in which a cylindrical stainless steel indenter with an outer diameter of 16 mm and an axial length of 50 mm is pressed into the elastic layer by 0.73 mm, a rate of decrease from a repulsive force of the elastic layer before the indenter is pressed into the elastic layer to a repulsive force of the elastic layer six hours after an amount of the indenter pressed into the developer supply member reaches 0.73 mm is not less than 27% and not more than 31%.

8. The development unit according to claim 6, wherein an Asker F hardness of the elastic layer is greater than or equal to 40 and less than or equal to 46.

9. An image formation apparatus comprising:

the development unit according to claim 6;

a transfer unit that transfers a developer image formed on the image carrier to a medium; and a fixation unit that fixes the developer image transferred to the medium to the medium.

10. The development unit according to claim 1, wherein wear characteristics of the developer supply member are such that, the developer supply member is rotated at a circumferential speed of 136.1 mm/sec in a state in which a stainless steel indenter including a surface in a shape of a 50 mm square and a thickness of 10 mm is pressed into the elastic layer of the developer supply member by 0.73 mm such that an abrasive film including a grain size of 30 μm fixed on the surface of the indenter is in press contact with a surface of the elastic layer, an amount of decrease in an outer diameter of the developer supply member, obtained by subtracting a value of the outer diameter of the developer supply member when the indenter is separated from the developer supply member 250 seconds after an amount of the indenter pressed into the developer supply member reaches 0.73 mm from a value of the outer diameter of the developer supply member before the indenter is pressed into, is 0.03 mm or less.

* * * * *